US008955232B2

(12) United States Patent
Cunningham

(10) Patent No.: US 8,955,232 B2
(45) Date of Patent: Feb. 17, 2015

(54) LAUNDRY DRYER/VENTING SYSTEM INTERLOCK

(75) Inventor: J. Vern Cunningham, Aurora (CA)

(73) Assignee: Cube Investments Limited, Aurora, ON (CA)

( * ) Notice: Subject to any disclaimer, the term of this patent is extended or adjusted under 35 U.S.C. 154(b) by 1290 days.

(21) Appl. No.: 12/457,980

(22) Filed: Jun. 26, 2009

(65) Prior Publication Data

US 2010/0000118 A1 Jan. 7, 2010

Related U.S. Application Data

(60) Provisional application No. 61/076,424, filed on Jun. 27, 2008.

(51) Int. Cl.
*D06F 58/28* (2006.01)
*D06F 58/20* (2006.01)
(Continued)

(52) U.S. Cl.
CPC ..... *D06F 58/20* (2013.01); *D06F 58/28* (2013.01); *D06F 2058/2864* (2013.01)
USPC ..... 34/87; 34/546; 34/572; 34/140

(58) Field of Classification Search
CPC ..... D06F 58/20; D06F 2058/2887; D06F 2058/2858; F26B 25/00; F26B 21/06; F26B 11/02
USPC ..... 34/443, 487, 491, 524, 544, 546, 554, 34/572, 604, 140, 235, 87; 454/343
See application file for complete search history.

(56) References Cited

U.S. PATENT DOCUMENTS 3,099,201 A * 7/1963 Gottlieb ..... 454/329
3,195,034 A * 7/1965 Bensema ..... 417/44.11
(Continued)

FOREIGN PATENT DOCUMENTS

CA 2275029 A1 * 1/2000 ..... D06F 58/20
EP 0312072 4/1989
(Continued)

OTHER PUBLICATIONS

Fantech Ventilation Solutions for the Laundry, 2006 (As Submitted by Applicant).*
(Continued)

*Primary Examiner* — Kenneth Rinehart
*Assistant Examiner* — Tavia Sullens

(57) ABSTRACT

While a dryer is running, continuously automatically monitor operation of a dryer venting system, and continuously automatically determining if the dryer venting system is operating improperly, and if it is determined that the dryer venting system is operating improperly then automatically disabling the dryer. If the dryer starts running then automatically turning on a booster fan. Operation of booster fan is monitored by sensing the current drawn. Monitoring operation of the venting system through a first controller and automatically disabling the dryer through a second controller. Automatically turn off the booster fan if the dryer is not running. Automatically adjust operating parameters of the dryer venting system in an attempt to operate the venting system properly, and disabling the dryer if the venting system continues to operate improperly after adjustment. Check to determine if the dryer is drawing current to indicate the dryer is running.

5 Claims, 25 Drawing Sheets

(51) Int. Cl.

| | |
|---|---|
| ***F26B 11/02*** | (2006.01) |
| ***F26B 21/06*** | (2006.01) |
| ***F26B 19/00*** | (2006.01) |

(56) References Cited

U.S. PATENT DOCUMENTS

| | | | | |
|---|---|---|---|---|
| 3,748,746 | A | 7/1973 | Robandt | |
| 4,115,485 | A | 9/1978 | Genessi | |
| 4,419,589 | A * | 12/1983 | Ross | 307/39 |
| 4,487,363 | A * | 12/1984 | Parker et al. | 417/280 |
| 4,586,267 | A * | 5/1986 | Sussman | 34/490 |
| 4,589,331 | A * | 5/1986 | Villamagna et al. | 454/239 |
| 4,689,896 | A * | 9/1987 | Narang | 34/82 |
| 5,224,648 | A * | 7/1993 | Simon et al. | 236/51 |
| 5,372,120 | A * | 12/1994 | Swilik et al. | 431/78 |
| 5,560,124 | A * | 10/1996 | Hart et al. | 34/572 |
| 5,808,846 | A * | 9/1998 | Holce et al. | 361/31 |
| 5,860,858 | A * | 1/1999 | Wettergren | 34/235 |
| 6,125,759 | A * | 10/2000 | Epps | 101/484 |
| 6,220,092 | B1 * | 4/2001 | Catbagan | 34/89 |
| 6,322,443 | B1 * | 11/2001 | Jackson | 454/329 |
| 6,364,211 | B1 * | 4/2002 | Saleh | 236/49.3 |
| 6,637,127 | B2 * | 10/2003 | Reede et al. | 34/606 |
| 6,671,977 | B2 * | 1/2004 | Beaumont | 34/79 |
| 6,779,279 | B2 * | 8/2004 | Lee et al. | 34/82 |
| 6,785,981 | B1 * | 9/2004 | Harpenau | 34/140 |
| 7,213,349 | B1 | 5/2007 | Brunner | |
| 2004/0159008 | A1 * | 8/2004 | Harpenau | 34/595 |
| 2004/0187343 | A1 | 9/2004 | Beaumont | |
| 2006/0152178 | A1 * | 7/2006 | Carow | 318/66 |
| 2006/0288608 | A1 * | 12/2006 | Carow et al. | 34/604 |
| 2007/0062061 | A1 * | 3/2007 | Carow | 34/443 |
| 2007/0156253 | A1 * | 7/2007 | De Silvio | 700/6 |
| 2008/0005926 | A1 | 1/2008 | Goggin | |
| 2008/0034611 | A1 * | 2/2008 | Carow et al. | 34/565 |

FOREIGN PATENT DOCUMENTS

| | | | | |
|---|---|---|---|---|
| EP | 0312072 | A1 * | 4/1989 | D06F 58/28 |
| EP | 0312072 | B1 | 3/1993 | |
| EP | 0312072 | B1 * | 3/1993 | D06F 58/28 |
| WO | WO 02/04736 | A2 * | 1/2002 | D06F 58/22 |
| WO | WO 0204736 | A2 | 1/2002 | |

OTHER PUBLICATIONS

Fantech DBF4XLT Dryer Booster Fan. Rev. Date: May 18, 2006.*

UL 705 Standard for Power Ventilators, Fifth Edition (rev.), Jun. 2, 1994: pp. 12, 20, and 41.*

UL 507 Standard for Electric Fans, Sixth Edtion (rev.), Mar. 22, 1990: pp. 9, 25, and 50.*

Fantech, Ventilations for the Laundry; Booster Fans, Airflow Sensors and Lint Traps, SBL0906 dated Sep. 2006.

"UL 705 Supplemental Requirements: Dryer Exhaust Duct Power Ventilators for Single Residential Dryers; Draft Feb. 1, 2008.".

UL 705 Standard for Power Ventilators, Sixth Edition, Jan. 14, 2014.

* cited by examiner

LAUNDRY DRYER/VENTING SYSTEM INTERLOCK

CROSS REFERENCE TO RELATED APPLICATION

This application claims priority from, and is entitled to the benefit of the filing date of, U.S. patent application No. 61/076,424 entitled LAUNDRY DRYER BOOSTER FAN INTERCONNECT, filed 27 Jun. 2008. The content of the above application is hereby incorporated by reference into the detailed description hereof.

FIELD OF THE INVENTION

This invention is related to the general field of laundry dryers and venting therefor.

BACKGROUND OF INVENTION

Laundry dryers typically have a rotating drum through which air flows in order to dry washed laundry within the drum. The laundry may simply be wet but not washed, for example where a user wants to dry his or her clothes after being caught in a rain storm. The air is typically heated in order to carry more moisture from the laundry.

Laundry dryers come in two main types: vented and condenser. A condenser dryer removes the moisture in the exhaust air from the drum so that the air may be released into the same room as the dryer. A vented dryer exhausts the air into a vent duct connected to the dryer for release at a location where the moist air will not have significant adverse effects. Typically the vent duct allows for transportation of the moist air to the outdoors.

Vented dryers are typically more efficient than condenser dryers for the same cost. Condenser dryers are usually used in locations where vent ducts are impractical to install.

Vented dryers are typically designed for use with short runs of vent duct. If a vent duct is longer than that for which the dryer id designed then the flow through the vent duct may be reduced. In addition to exhausting moist air, dryers also exhaust lint from the drying process. Lint often collects in the vent duct. If the flow through the vent duct is reduced then more lint will collect in the vent duct. This further reduces the flow.

Reduced flow decreases the efficiency of the drying process. It can also increase heat build-up within the vent duct or dryer. This can result in a fire within the dryer or the vent duct. It is important to maintain air flow through the dryer and vent duct when heated in order to limit the risk of combustion.

Booster fans are typically provided in duct vent runs longer than the designed for the dryer. The booster fan helps to maintain proper air flow through the vent duct. Booster fans are typically designed to start when differential pressure within the vent duct is at or greater than a given amount indicating that the dryer is running. Similarly, the booster fan will turn off when the differential pressure is below that amount.

Improvements to, or alternatives for, existing dryer and booster fan systems, dryers, dryer venting systems and dryer/dryer venting combinations, and methods related thereto are desirable.

SUMMARY OF INVENTION

In an aspect embodiments of the present invention provide a method for use with a dryer having a dryer venting system.

The method includes the steps of, while the dryer is running, continuously automatically monitoring operation of the dryer venting system, continuously automatically determining if the dryer venting system is operating improperly, and, if it is determined that the dryer venting system is operating improperly, then automatically disabling the dryer.

The dryer venting system may include a booster fan, and the method may further include the steps of continuously automatically checking whether or not the dryer is running, and if the dryer starts running then automatically turning on the booster fan.

The dryer venting system may include a booster fan and the method may include the operation of the booster fan being continuously automatically monitored, and continuously automatically determined as part of the steps of continuously automatically monitoring operation of the dryer venting system and continuously automatically determining if the dryer venting system is operating improperly.

The operation of the booster fan may be continuously automatically monitored by sensing the current drawn by the booster fan.

The step of monitoring operation of the venting system may further include monitoring operation of the venting system through a first controller, and the step of automatically disabling the dryer may further include automatically disabling the dryer through a second controller, and the method may further include the step of communicating between the first and second controllers via wireless signals.

The step of communicating between the first and second controllers via wireless signals may further include communicating between the first and second controllers via radio frequency wireless signals.

The method may further include the step of learning operational one or more parameters of the venting system in use after installation, such parameters for use in the step of automatically determining.

The method may further include the step of automatically turning off the booster fan if the dryer is not running.

The method may further include the step of automatically setting an alarm when it is determined that the dryer venting system is operating improperly.

The method may further include the step of, if it is determined that the venting system is operating improperly then, while the dryer is running, automatically adjusting operating parameters of the dryer venting system in an attempt to operate the venting system properly, and prior to the step of automatically disabling the dryer if the venting system continues to operate improperly after adjustment.

The method may further include the step of automatically re-enabling the dryer after a period of time. The step of disabling the dryer may include disabling the dryer by interrupting power to the dryer. The step of checking may further include checking to determine if the dryer is drawing current to indicate the dryer is running.

In another aspect embodiments of the invention provide a method for use with a dryer having a dryer venting system including a booster fan. The method includes the steps of, while the dryer is running, automatically adjusting operating parameters of the dryer venting system to desired settings, automatically monitoring operation of the adjusted dryer venting system, and automatically determining if the dryer venting system is operating improperly.

In a further aspect embodiments of the invention provide a system including a dryer, a dryer venting system including a booster fan, and an interlock adapted to continuously automatically monitor the venting system, adapted to continuously automatically determine if the dryer venting system is operating improperly, and adapted to automatically disable the dryer if the interlock determines that the dryer venting system is operating improperly.

In another further aspect embodiments of the invention provide a dryer interlock for use with a dryer and a dryer venting system. The interlock includes a sensor configured to be placed in the dryer venting system to sense operation of the dryer venting system, and a controller operationally connected to the sensor and configured to monitor the sensed operation from the sensor. The controller is configured to determine if the sensed operation is indicative of improper operation of the dryer venting system, and to disable the dryer if the controller determines that the sensed operation is indicative of improper operation of the dryer venting system.

The dryer venting system may include a booster fan. The controller of the dryer interlock may further include a dryer controller and a booster fan controller, wherein the sensor is operationally connected to the booster fan controller and the booster fan controller is configured to monitor the sensed operation from the sensor, and the dryer controller is configured to disable the dryer if the controller determines that the sensed operation is indicative of improper operation of the dryer venting system, and the booster controller and dryer controller are configured to allow the booster controller to communicate with the dryer controller.

The booster controller and dryer controller may be configured to communicate wirelessly. The dryer controller may be configured to operationally connect between mains power and the dryer such that the dryer controller can disable the dryer by interrupting power to the dryer.

The dryer controller may include a relay to operationally connect between mains power and the dryer such that the dryer controller can disable the dryer by interrupting power through the relay.

The sensor may include a current sensor configured to be operationally connected to the booster fan to sense the current drawn by the booster fan.

The booster fan controller may be further configured to turn on the booster fan, and the dryer controller may be further configured to sense running of the dryer, and the dryer controller may be configured to communicate with the booster fan controller when the dryer controller senses that the dryer is running, and the booster fan controller may be configured adapted to turn on the booster fan when the dryer controller senses that the dryer is running and communicates with the booster fan controller.

Other aspects of the invention will be evident from the detailed description and drawings hereof. For example, such aspects may include alternative combinations of the elements of the aspects set out above, and combinations that include fewer or more elements in combination with other elements from the detailed description, or combinations that are drawn from the detailed description alone.

BRIEF DESCRIPTION OF DRAWINGS

For a better understanding of the present invention and to show more clearly how it may be carried into effect, reference will now be made, by way of example, to the accompanying drawings that show the preferred embodiment of the present invention and in which.

DETAILED DESCRIPTION OF THE PREFERRED EMBODIMENTS

It is to be noted that numerous components are similar for different embodiments described herein, and components from one embodiment can be used on other embodiments. The description for similar components in different embodiments applies equally to all embodiments unless the context specifically requires otherwise. Components from one embodiment can be applied to other embodiments unless the context specifically requires otherwise, and specific reference to the cross-application of such components will not be made for each embodiment, but is expressly stated hereby.

In this description the operation of dryers will be discussed. The following terms will be used in the following context.

A dryer is said to be "running" when the dryer is rotating, or attempting to rotate, a dryer drum within the dryer. A dryer that is not running is said to be stopped. The terms "running" and "stopped" are used to distinguish from a dryer "on" state, in particular with respect to dryers with electronic controls. A dryer can be "on" in the sense that it is ready to receive user input (activating switches), while stopped.

Further, a dryer is considered to be disabled when the dryer is not in the running state and cannot be placed in the running state by the user.

A dryer is said to be "enabled" when the dryer is in a running state or the dryer is otherwise able to be placed in a running state by a user. For example, a dryer that is connected to receive power is typically enabled. A user can simply place the dryer into a running state by pushing a button on the dryer. For some dryers the user may first have to turn the dryer on. The dryer is still considered to be in an enabled state as the user can place the dryer into a running state by turning on the dryer and pushing a button.

Figure 1:
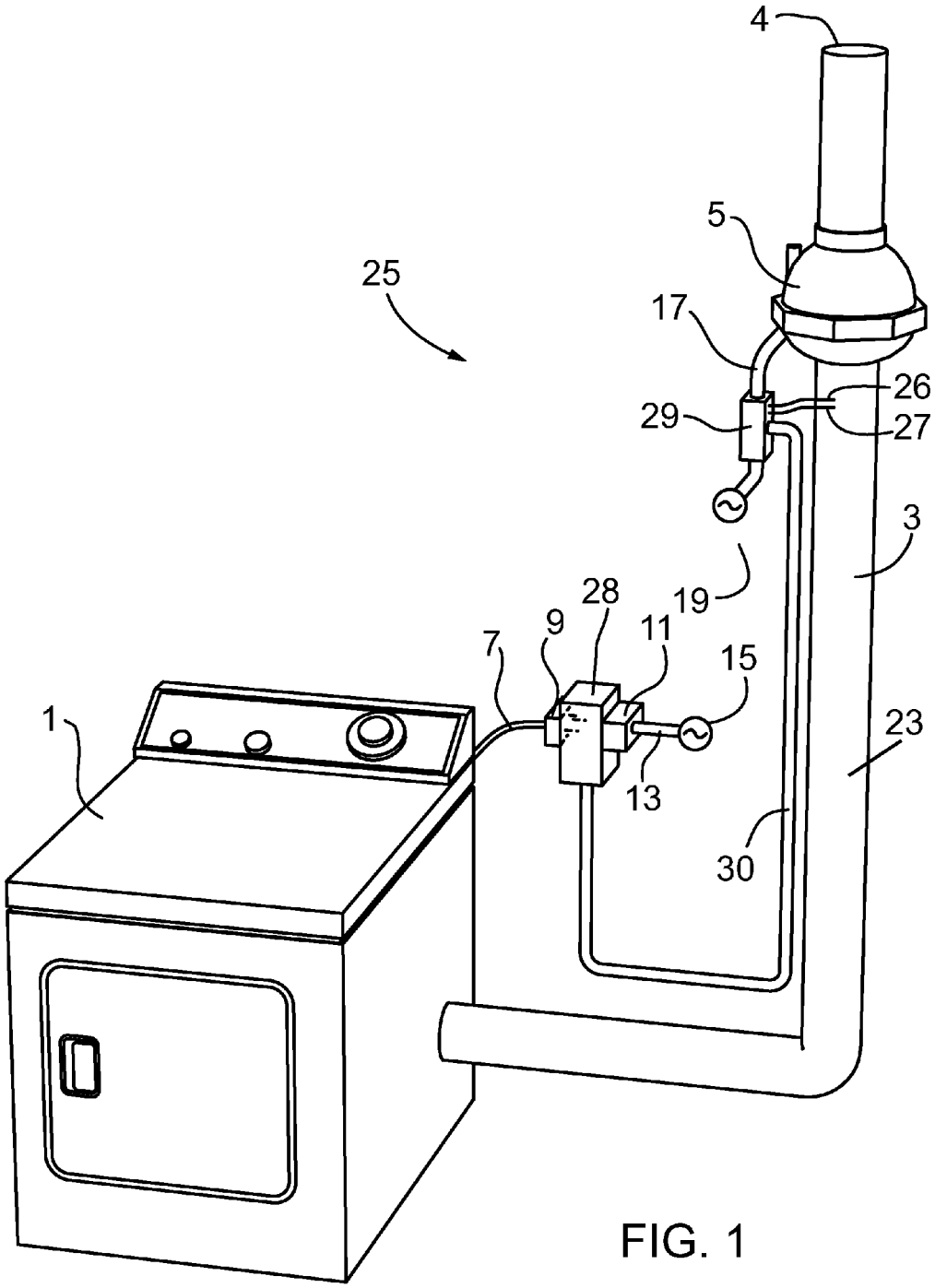
FIG. 1 is a sketch of a dryer interlock of an example embodiment of an aspect of the present invention in association with a dryer and dryer vent system.

A dryer is said to be re-enabled when disabling cause is removed. For example, if a dryer is disabled by unplugging the dryer then the dryer is re-enabled by plugging it in. Referring to FIG. 1, a dryer 1 has a vent duct 3 to carry warm moist air away from the dryer 1 to a vent 4. In the FIG. the vent 4 is simply shown as a circular opening at the end of the vent duct 3. Typically the vent 4 will include a vent cap, such as for example a flapper valve with or without a screen, to prevent cold air and foreign matter, such as for example rodents, dirt or water, from entering the vent duct 3. A booster fan 5 is connected inline with the vent duct 3. The booster fan 5 assists the dryer 1 in carrying the air away from the dryer 1 through the vent duct 3.

It is to be recognized that the dryer 1, vent duct 3 and booster fan 5 shown in the FIGS. are examples only and that different configurations can be used depending on the particular configuration of the structure in which the dryer 1 is installed, the type of dryer 1 to be installed and the model of booster fan 5 selected. Although this description will be made with reference to its use in association with an electric dryer 1, many of the features and functions described herein can be adapted for dryers using other energy sources; for example, a gas dryer 1 could be used with appropriate modification.

The dryer 1 has a standard cord 7 and plug 9 for connection through a receptacle 11 and conductors 13 to a source of energy 15 to operate the dryer 1. Typically electric dryer 1 will operate using three phase energy and the cord 7 and plug 9 will be adapted accordingly. It is to be recognized that it is not necessary that the dryer 1 operate from three phase energy; however, this is a fairly standard dryer 1 design.

Similarly, the booster fan 5 is connected by electrical conductors 17 to a source of energy 19 to operate the booster fan 5. The booster fan 5 could be provided with a cord and plug similar to the dryer 1, recognizing that booster fans will typically operate from standard two phase energy, such as a 120 volt AC source standard in North America. Typically booster fan 5 will be hardwired to a source of energy as the booster fan 5 will typically be installed within an unfinished space such as an attic or a crawl space.

A dryer venting system 23 typically includes the dryer 1, vent duct 3 and vent 4. Where a booster fan 5 is used then the booster fan 5 would also be considered part of the dryer venting system 23. It is to be recognized that a dryer venting system is not required in all cases to have a booster fan 5. The booster fan 5 is utilized in cases where there would otherwise be insufficient flow through the vent duct 3, for example as a result of too great a length vent duct 3 between the dryer 1 and the vent 4.

The dryer venting system 23 further includes a dryer vent interlock 25. In operation, the dryer vent interlock 25 checks that the venting system 23 is operating properly. If the venting system 23 is operating improperly while the dryer 1 is running then the interlock 25 disables the dryer 1. Examples that may cause the dryer venting system 23 to act improperly include, for example, failure of the dryer 1 to adequately exhaust air from the dryer 1, a blockage in the vent duct 3, a blockage in the vent 4 or a failure of the booster fan 5.

The interlock 25 can, for example, have a pressure sensor 26 for sensing pressure within the vent duct 3 between the dryer 1 and the booster fan 5. Similarly, the interlock 1 can, for example, have a temperature sensor 27, such as a thermistor, for sensing temperature in the vent duct 3. The interlock 25 can, for example, have one or more motor status sensors to sense the status of one or more motors with the dryer vent system 23. For example, a motor sensor can be utilized in association with the booster fan 5. Also, a motor sensor can be utilized in association with the integral fan of dryer 1. A motor sensor can be implemented in many ways or a combination of ways as will be discussed further below.

In operation, the interlock 25, for example, checks that the dryer venting system 23 is operating properly, for example, by checking the pressure in the vent duct 3 is within an acceptable range. An example of an upper bound for the static pressure in an inlet to the booster fan 5 is 0.16 inches (4 mm) of water column. The range may vary based upon the installation as will be evident to those skilled in the art. If pressure is building above the acceptable range in the vent duct 3 then the dryer venting system 23 is operating improperly. Similarly, the interlock 25 checks that the dryer venting system 23 is operating properly, for example, by checking the temperature in the vent duct 3 is within an acceptable range. As an example, the maximum temperature could be 149 degrees Fahrenheit if the booster fan is a minimum of 15 feet from the dryer 1 and 167 degrees Fahrenheit if the booster fan is 5 feet from the dryer 1. If temperature is building above the acceptable range in the vent duct 3 then the dryer venting system 23 is operating improperly. The interlock 25 can be set to turn off the booster fan when the maximum temperature is reached. This may prevent a fire from starting, or smother an existing fire.

Initially, the interlock 25 can, for example, turn on the dryer vent system 23 when the dryer 1 runs. Typically the dryer 1 will have its own internally mounted fan, not shown, that is turned on automatically by the dryer 1. Although not further described herein, the interlock 25 can assume this function for the dryer, particularly if all or a portion of the interlock 25 is mounted within the dryer 1. Similarly, the interlock 25 can turn on the booster fan 5 when the dryer 1 is running. In many cases, booster fans 5 are pressure sensor activated from a remote pressure sensor. If so, the interlock 25 can allow activation of the booster fan 5 using a pressure sensor connected to the booster fan directly, rather than through the interlock 25.

The interlock 25 can include a timer to disable operation of the dryer 1 for a minimum period of time after the dryer 1 has been disabled by the interlock 25 for improper operation of the venting system 23. As an example, the dryer could be disabled for a two minute time period. During this period one or more alarms can be provided to a user, for example a visual or audible alarm. An example of a visual alarm described herein include an error LED on the controller 28. An error LED can be provided on the controller 29; however, the controller 29 is typically installed in a location that is not readily visible to a user. An example of an audible alarm described herein includes piezoelectric buzzers that operate from the controllers 28, 29, for example to provide a chirp in the event of improper operation of the venting system 23.

An example dryer vent interlock 25 has a dryer controller 28 and a booster fan controller 29 connected by wires 30.

Figure 2:
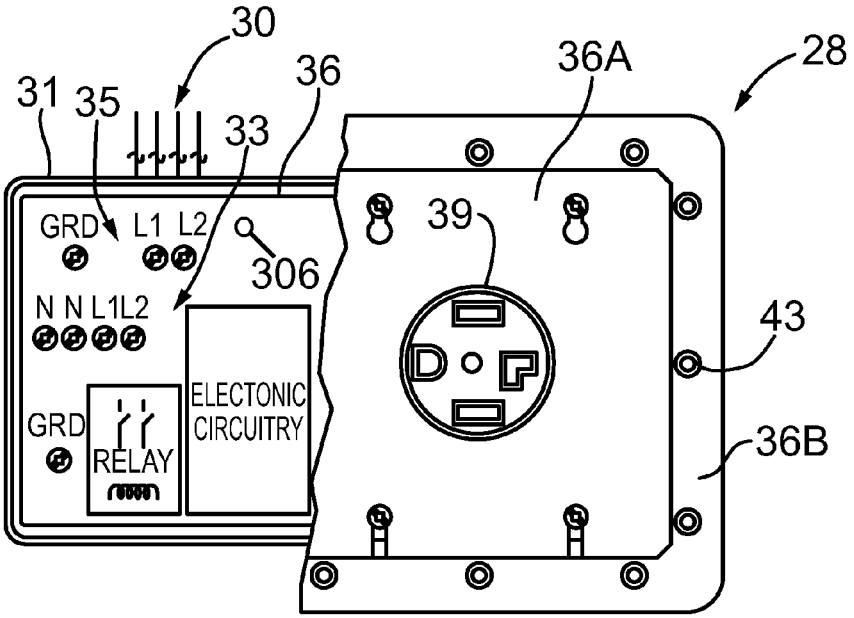
FIG. 2 is a front view of an example dryer controller in accordance with an embodiment of an aspect the present invention for use in the dryer interlock of FIG. 1, with a portion of a cover of the dryer controller removed.
Figure 3A:
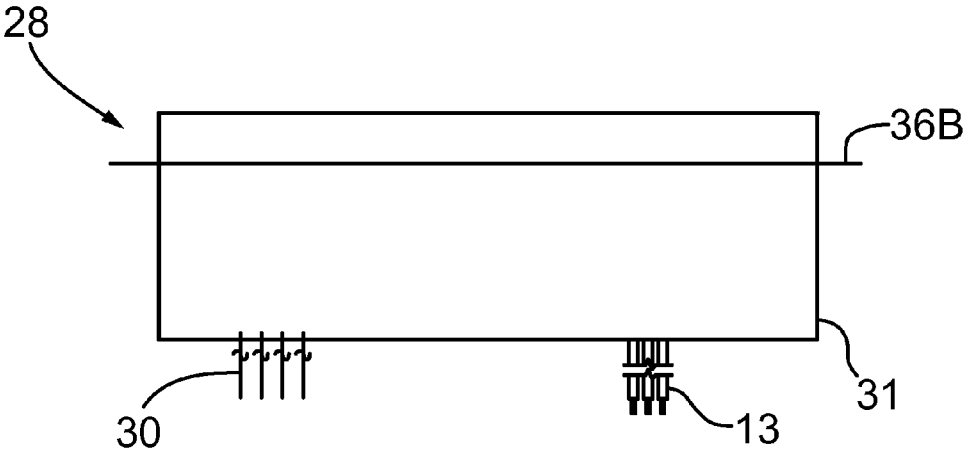
FIG. 3A is an example top view of the dryer controller of FIG. 2 in accordance with an embodiment of an aspect the present invention for use in the dryer interlock of FIG. 1, FIG. 3B. is a top view of another example dryer controller in accordance with an embodiment of an aspect of the present invention for use in the dryer interlock of FIG. 1.

Referring in detail to FIG. 2 and FIG. 3A, the dryer controller 28, for example, has a housing 31 within which is mounted controller circuitry 33 and connectors 35, such as terminal blocks, to the wires 30 and the conductors 13. A portion 36 of the housing 31 is shown with cover 36A and flange 36B broken away such that the circuitry and connections are visible in the FIG. A cover 36A would typically be provided to enclose the circuitry 33 and connectors 35 within the housing 31. A hole or other means could be provided in the broken away portion of the cover 36A to allow for the failure indicator 306 (error LED) to be viewable outside the housing 31 when in use.

The housing 31 can be fixed in place using screws or the like, not shown, through holes 43 (one of which is labeled) in flange 36B. The flange 36B can be set back from a front surface of the housing to allow for drywall or other wall surface treatments. Other mounting configurations and methods can be used as are known for electrical receptacle housings.

Figure 3B:
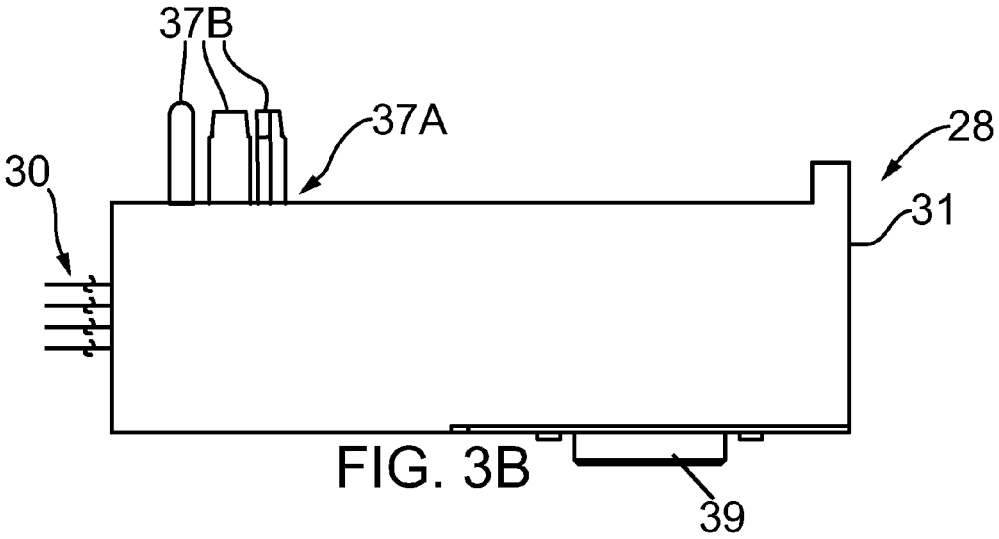
FIG. 3C is a top view of a further example dryer controller in accordance with an embodiment of an aspect of the present invention for use in the dryer interlock of FIG. 1.

Referring to FIG. 3B, the controller 28 may have the flange 36B removed and a plug 37A extending from the rear of the housing 31 for connection to a corresponding receptacle 11. The receptacle 11 will typically be connected to a 3 phase 240V source 15 in North America. Such receptacles 11 typically have three or four slots. Accordingly, the plug 37A will have three or four corresponding prongs 37B for connection with the slots. On the face of the housing 31 is a receptacle 39 for connection with the plug 9. The receptacle 39 is similar to the receptacle 11 as such receptacles are fairly standard. As the receptacle 11 will typically extend outwardly from a wall within a dwelling (see for example how the receptacle 39 extends from the face of the housing 31), the prongs 37B are placed to one side of the rear face of the housing 31 and a standoff 41 extending from the rear face the depth a standard receptacle 11 extends from the wall. This helps to keep the housing 31 from wobbling on the prongs 37B. Four control wires 30 extend from a top or rear of the housing 31. In the example described, two control wires 30 are used to send signals from the controller 28 to the control 29, while the other two wires 30 are used to send signals from the controller 29 to the controller 28. It is to be recognized that other wired communication techniques can be used to reduce the number of wires 30. Also, additional wires can be used if desired to communicate more information while not increasing signaling complexity.

In FIG. 3B the wires 30 are moved to a side of the housing 31. Wires within the housing 31 are not shown for clarity. It is understood that wires or other internal connections are provided to complete the circuitry, examples of which are described elsewhere herein. When wires, such as wires 30 and conductors 13 enter the housing 31 connections are made to the connectors 35 which are in turn connected to the circuitry 35.

Figure 3C:
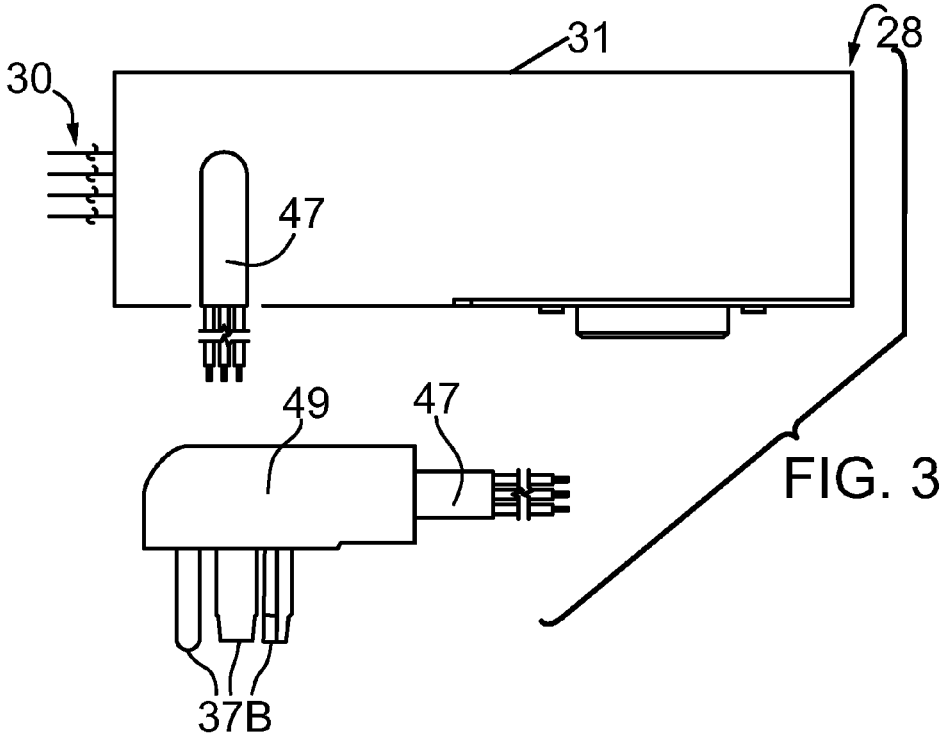

Referring to FIG. 3C, a further example controller 28 could utilize a cord 47 extending from the housing 31, preferably not on the rear mounting face of the housing 31. The cord 47 terminates in a plug 49 that provides prongs 37B. This allows the rear face to be mounted flat against a wall or other surface at a distance away from the receptacle 11. In this way the controller 28 would not interfere with the dryer location if the dryer is mounted near to the receptacle 11. Also, the controller 28 can be located in a desired position for visibility and access.

As other examples, the controller 28 may be integrated within the dryer 1 or hardwired within the receptacle 11 into a wall of a dwelling. In either case, having two receptacles 11 and 39 could be avoided.

Where the controller 28 is integrated into the dryer 1 it may be desirable to change the operation of the controller 28, for example, to have the interlock 25 re-enable the booster fan 5 when a user requests the dryer 1 to run. Then, if the venting system 23 is operating properly the dryer 1 can be allowed to start. The interlock 25 would then continue to monitor the venting system 23 and allow or prevent the dryer 1 from operating as appropriate. In this way it is not necessary to sense current being used by the dryer 1; rather, the controller 28 simply senses if the dryer 1 has been requested to run, for example, by a user pushing a button on the dryer 1 or activating an electronic control. This can be performed by other components of the dryer 1 signaling the controller 28.

Figure 4:
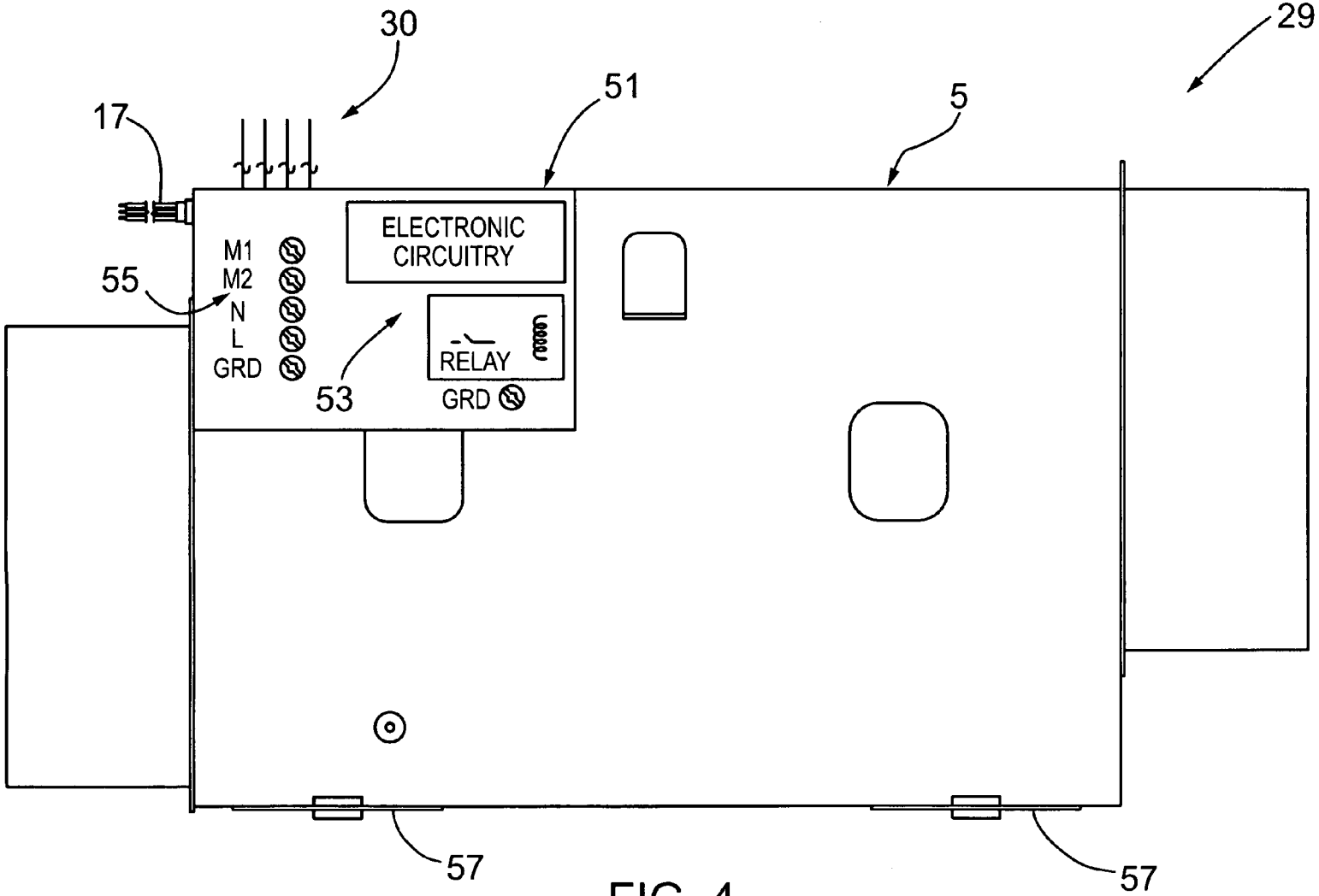
FIG. 4 is a front view of an example booster fan controller in accordance with an embodiment of an aspect of the present invention mounted on a booster fan for use in the dryer interlock of FIG. 1.

Referring in detail to FIG. 4, the booster fan controller 29 can, similarly, be mounted within a housing 51 enclosing circuitry 53 and connectors 55, such as terminal blocks. Again, a cover of the housing 51 has been removed to show the internal components of the booster fan controller 29. The controller 29 is connected inline with the conductors 17. Two control wires and two power wires 30 extend from the housing 51. The housing 51 can be fixed in place, for example, using screws or the like, not shown. Wires within the housing 51 are not shown for clarity. It is understood that wires or other internal connections are provided to complete the circuitry, examples of which are described elsewhere herein. When wires, such as wires 30 and conductors 17 to the source 19 and the fan 5, enter the housing 51 connections are made to the connectors 55 which are in turn connected to the circuitry 53. The conductors 17 to the source 19 are shown in the FIG. The conductors 17 to the fan 5 are not shown in the FIG. as those conductors, for example, exit the rear of the housing 51 for connection to the fan 5. The fan 5 is typically connected by screws or the like to a stud within a wall cavity through flanges 57.

A further example would be to mount the controller 29 within the booster fan 5, or hardwired within a junction box.

The pressure sensor 26 for sensing pressure can, for example, be mounted to sense pressure within the vent duct 3 between the dryer 1 and the booster fan 5. Similarly, the temperature sensor 27, such as a thermistor, for sensing temperature can, for example, be mounted to sense pressure within the vent duct 3 between the dryer 1 and the booster fan 5. The pressure sensor 26, the temperature sensor 27 and the motor status sensor can, for example, each be connected to the booster controller 29 to provide input to the booster controller 29.

In operation, the interlock 25 checks that the dryer venting system 23 is operating properly, for example, by checking the pressure in the vent duct 3 between the dryer 1 and the booster fan 5 is within an acceptable range. As pressure can be checked on a difference in pressure, a sensor could be placed between the fan 5 and the vent 4 with a small hose, not shown, to the intake of the fan 5 to provide the desired information. Similarly, the interlock 25 checks that the dryer venting system 23 is operating properly, for example, by checking the temperature in the vent duct 3 between the dryer 1 and the booster fan 5 is within an acceptable range. Again, the temperature sensor could also be placed after the booster fan 5 before the vent 4. Temperature in this location would also any heat added by the booster fan 5 itself. Some regulatory authorities specify a maximum air exhaust temperature, such as for example 302 degrees Fahrenheit.

The motor status sensor can check that the dryer venting system 23 is operating properly, for example, by checking the status of a motor within the system 23, such as for example, the motor of the booster fan 5.

The motor status sensor can, for example, include a current sensor for sensing the motor operating current. If there is an overcurrent condition then something jammed in an impeller or other suction creating device, not shown, attached to the motor, and the motor is working to overcome the obstruction. Overcurrent might be determined by a current that is more than a given amount above the normal operating current of the motor. The actual thresholds used will depend on the particular specifications for the motor used in any particular application. A self learning mode can be included in the controller 28 that would allow for automatically determining the motor current at the time of installation and storing this information, for example, in a microprocessor. This could include the current rating for open orifice as well as closed orifice.

In order to provide specifications on which a threshold can be based the controller 28 can have a non-volatile memory in which the specifications can be stored. The specifications can be sensed during normal operating condition of the motor and stored. Such condition may be represented by the current drawn by the motor. This can easily be sensed by the current sensor under control of the controller 28 as the controller has access to conductors 17 through which current flows to the booster fan 5 (including its motor).

The normal operating condition of the motor could also be input directly by an installer, or at the time of manufacture. If the normal operating conditions are input at the time of manufacture or installation then a write once memory device, such as a PROM, could be used, if desired.

As the interlock 25 may be used with many different motors, and the design specifications and operating environment of each motor may change from time, it is preferable simply to allow the interlock to sense automatically (i.e. without requiring data to be input by a manufacturer or installer) the normal operating condition when the interlock 25 is installed.

The interlock 25 can be configured to ignore any inrush current each time the motor is turned on if the inrush current would exceed the threshold amount and duration. The current sensor may be a current sensing transformer, current sensing resistor or other similar or alternative device.

The interlock 25 current sensor can, for example, also sense an undercurrent condition of the motor. An undercurrent condition can signify a blockage in dryer vent system 23. Such a blockage stops air flow, resulting in free spinning of the motor and a reduction in load on the motor.

The motor status sensor may also include a temperature sensor that monitors the temperature around the motor. An over temperature condition can be detected in comparison to normal operating temperature stored in memory. Repeated overtemperature conditions may indicate that maintenance is required.

The memory may also store the normal operating temperature (or other representation on which a threshold may be based) input, for example, in the manner described for the normal operating current, except possibly using the temperature sensor to sense normal operating temperature.

The motor status sensor can, for example, include an accelerometer or other vibration or motion sensor to sense for vibration. Unusual ongoing vibrations can be an indication that the balance of the motor is off, and the motor may be starting to fail. The normal and current conditions can be sensed with the normal condition being stored in memory for future comparison.

The interlock 25 can be used in association with an autodialer to provide information about the dryer vent system to a remote location through telephone lines. Contact could be made as a result of a sensed condition or the passage of time. The interlock 25 could also receive a remote call for diagnostic purposes.

Figure 14:
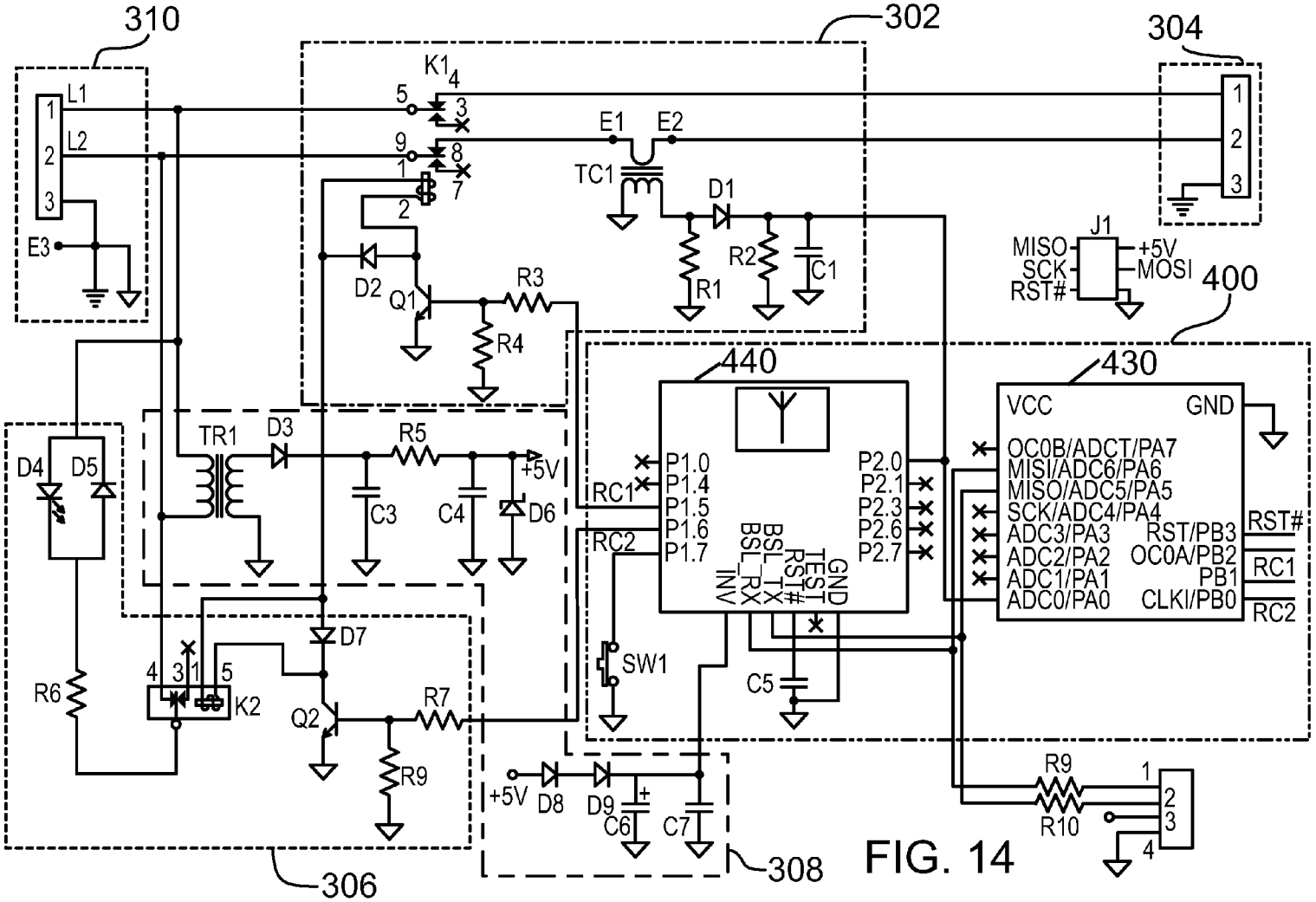
FIG. 14 is a detailed schematic diagram of a further example wired and wireless dryer controller in accordance with an aspect of the present invention for use in an interlock in accordance with an aspect of the present invention, such as the interlock of FIG. 1.

Referring to FIG. 14, the dryer controller 28 and the booster fan controller 29 can, for example, be connected by wires for intercommunication.

Figure 5:
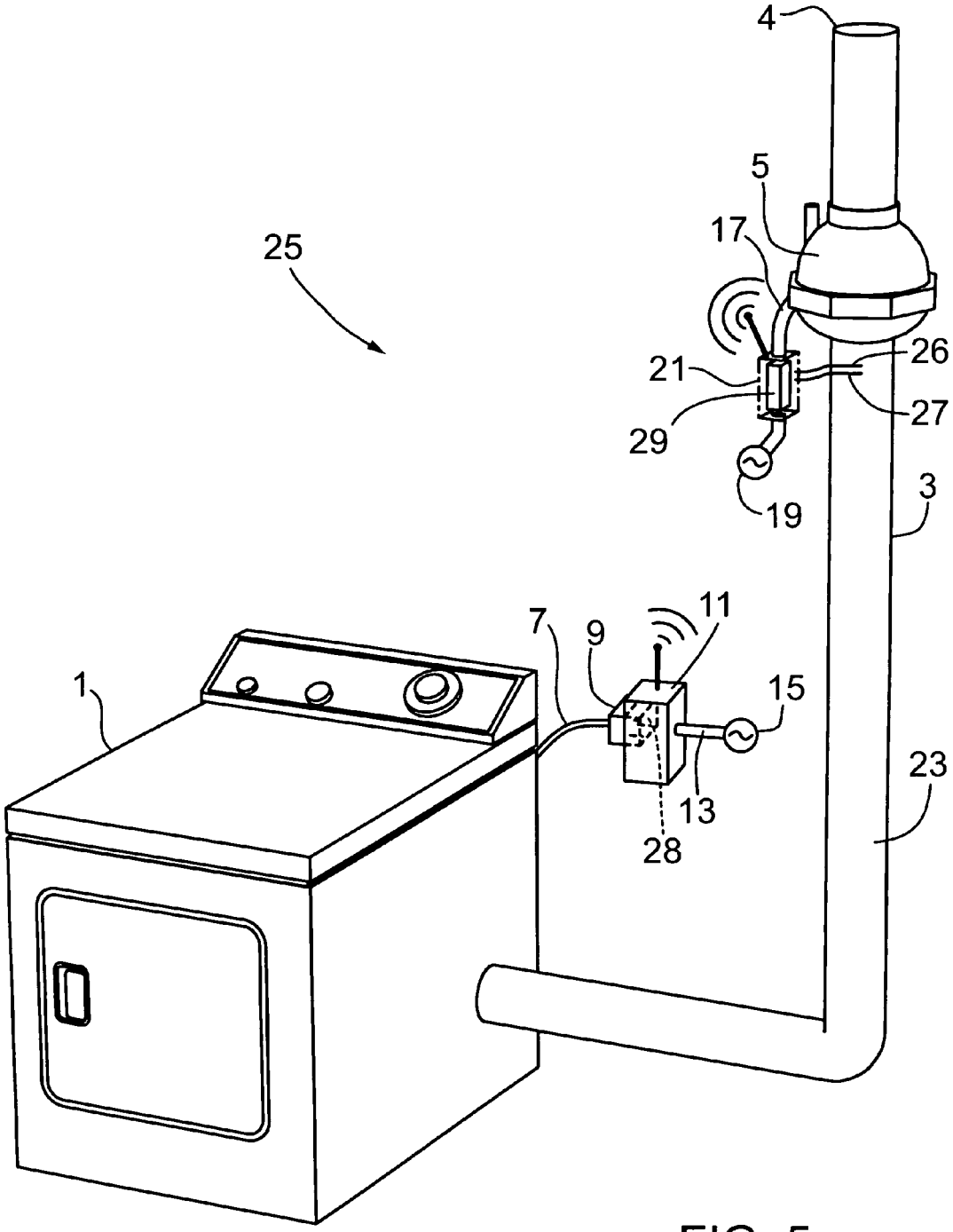
FIG. 5 is an alternate wireless embodiment of the dryer interlock of FIG. 1.

Referring to FIG. 5, the dryer controller 28 and the booster fan controller 29 can, for example, communicate wirelessly, for example, utilizing RF signals. As will be discussed later below, the dryer controller 28 and the booster fan controller 29 can be provided with components and connections for both wired and wireless communication while allowing selection between wired or wireless communication. In the wireless embodiments, the controllers 28, 29 can be matched for transmission and reception of signals over a selected distance through typical residential obstacles and building materials. The selected distance is a matter of choice, governed by applicable legal requirements such as might apply to signal strength and frequency. A digitally modulated radio frequency (r.f.) carrier of 433.92 MHz is suitable as it meets current North American and European requirements for r.f. (radio frequency) control systems.

Alternatively, r.f. transmissions can operate in spread-spectrum mode. This could include frequency hopping spread spectrum or direct-sequence spread spectrum (DSS). These techniques enable operation at higher r.f. power levels than single frequency operation by distributing the power over a number of different frequency channels. In this case, the carrier frequency could be in the 850-950 MHz or 2.4 GHz bands to comply with legal requirements in North America and Europe.

Other r.f. transmission techniques and frequencies could be used as desired for particular applications.

A microcontroller can be used as a transceiver in the controllers 28, 29 to provide digital encoding of r.f. carrier with message data, and to decode messages received. Other devices such as a microprocessor or discrete components could be used to perform these functions.

Wireless communication can provide some significant advantages, including obviating a need for control wires between the controllers 28, 29 and reducing the number and complexity of components within the controllers 28, 29 used to interface between wired controllers. The selection between wired and wireless communication can be made at the time of manufacture, or the manufacturer can leave this selection up to the installer. If the selection is made by the manufacturer than separate different controllers 28, 29 can be made for wired and wireless configurations. Wired, wireless and selectable wired, wireless versions are shown in the FIGS.

Figure 6:
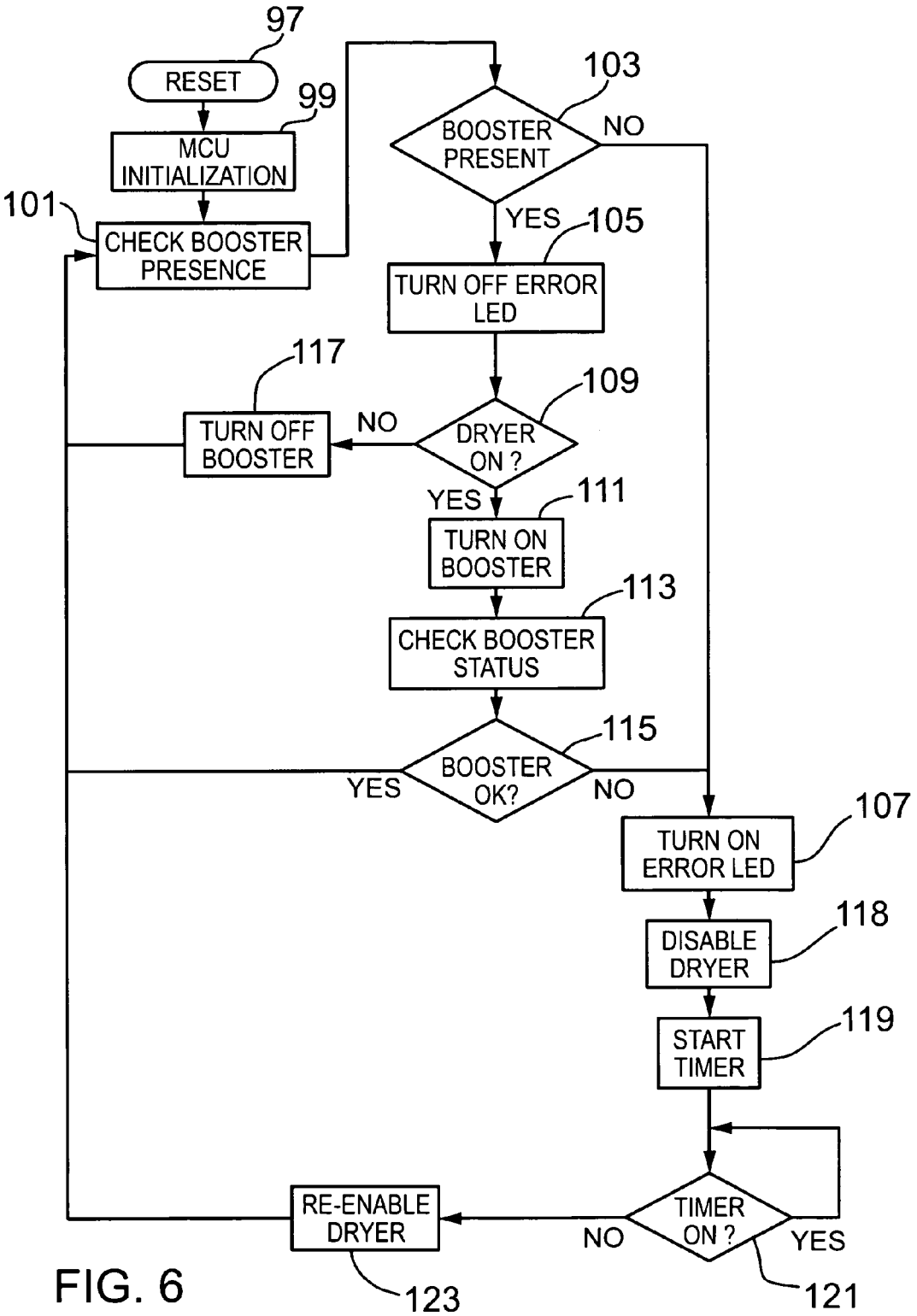
FIG. 6 is an example flowchart of the operation of an example dryer controller in accordance with an aspect of the present invention for use in an interlock in accordance with an aspect of the present invention, such as the interlock of FIG. 1 or 5.

Referring to FIG. 6, an example flowchart for the operation of the dryer controller 28 provides that the dryer controller 28 operates continuously when the dryer controller 28 is connected to a source of energy. Continuous operation is desirable as the dryer controller 28 is a safety device. In the example embodiments described herein the dryer controller 28 also operates from the same source of energy as the dryer 1, in which case the dryer 1 cannot operate without the dryer controller 28 operating. As an example, electronic circuitry before the relay 302 (see for example FIG. 8) is always energized. Normally closed contacts on the relay 302 ensure that the dryer 1 is normally re-enabled. Once current flow is detected, then an "ON" signal is sent to the booster fan controller 29. If the booster fan 5 does not come on within a predetermined period of time then a signal is sent to the dryer controller 28 and the relay is activated. Once activated, the relay contacts open and power is interrupted to the dryer 1, and the dryer is disabled.

If reset at 97 the controller 28 enters initialization at 99. The controller may be reset for example by initially energizing the controller 28, or by removing energy and providing it again. This may occur for example in the event of a power failure, so that the controller 28 automatically restarts. The controller 28 may also have an input for manual reset, such as a momentary switch to cause the controller 28 to reset.

After initialization and as part of a continuous process, the controller 28 checks at 101 if a booster fan 5 is present. This can be done by polling the booster fan controller 29. If at 103 a booster fan 5 is present then at 105 the controller 28 does not show an error, for example by turning off an error LED (an example discussion for which will be provided later below). As an alternative example, the controller 28 could actively display that a booster fan 5 is present by illuminating the LED in a positive manner, for example using the colour green. If the booster fan 5 is not present then at 107 a visible alarm is provided, for example through illumination of an error LED at the controller 28 and continues at 118 as described later below. Other forms of alarm could be provided, such as for example a buzzer or siren. An alarm is provided at the controller 28 for booster fan related problems as the booster fan controller 29 is typically not easily accessible during use.

It is to be recognized that the booster fan controller 29 could provide an alarm to an accessible location if desired, for example at a remote location through wired or wireless communication, or by moving the booster fan controller 29 to an accessible location and connected to one or more sensors from a distance through wires or wirelessly. As a further alternative, the functions of the booster fan controller 29 and the dryer controller 28 could be integrated with one or more booster fan sensors connected to the integrated controller from a distance through wires or wirelessly.

At 109 the controller 28 checks to see if the dryer 1 is running. If so, the controller 28 turns on the booster fan 5 at 111 by instructing the booster fan controller 29. In the example embodiments discussed herein the booster fan 5 can be "turned on" in the sense that power is provided to the booster fan 5 by the booster fan controller 29. The booster fan 5 then continues with its normal operation. It is to be understood that other methods can be used to turn on the booster fan, for example, through direct communication to the booster fan where the booster fan 5 is provided with an external control input.

Continuing with the provision of power example embodiment, if the booster fan 5 is pressure activated through its own sensor and pressure activation controller, not shown, as is known in the art then the booster fan 5 can continue to be pressure activated. Alternatively, if the booster fan 5 is activated by a manual switch then the switch can be left in the on-position and the booster fan 5 can be directly controlled by the provision of power to the booster fan 5. As a further example alternative, the booster fan 5 can be controlled directly from the provision of power by the booster fan controller 29.

After the dryer controller 28 instructs the booster fan controller 29 to provide power to the booster fan 5, the controller 28 checks the status of the booster fan 5 at 113, for example, by communicating with the booster fan controller 29. If at 115 the controller 28 determines that the booster fan 5 is OK, or operational, then the controller 28 returns to 101 and repeats the steps from there.

If at 109 the dryer 1 is not running then at 117 the controller 28 turns off the booster fan 5, for example, by instructing the booster fan controller 29 to cease providing power to the booster fan 5. The controller 28 then returns to 101 and repeats the steps from there.

If at 115 the controller 28 determines that the booster fan 5 fails to be operational then at 107 an error LED is indicated as described above and at 118 the controller 28 disables the dryer 1, for example, by ceasing to provide power to the dryer 1. In the embodiment currently being described if the booster fan 5 is not present then this will cause an operational failure when the booster status is checked. Then at 119, the controller 28 starts a timer to provide a delay. This prevents a false interruption of the system. If at 121 the timer is on then the controller 28 returns to step 121.

If at 121 the timer has expired then the controller 28 at 123 re-enables the dryer 1 in the sense of providing power to the dryer 1. The dryer 1 then continues its normal operation. For example, if the dryer 1 is mid-cycle the dryer 1 may continue its cycle. Many dryers 1 will reset if power ceases to be provided and is then provided again. This may require user input to dryer 1 to restart the cycle. The operation of the dryer 1 after it is re-enabled by the controller 28 will depend on the dryer 1. The dryer 1 could be provided with an input such that the controller 28 can disable and re-enable the dryer 1 through direct instructions from the controller 28. As another example alternative the controller 28 may be integrated with the dryer 1 as discussed previously, in this case, the integrated dryer 1 may allow for additional features such as for example the storage of the dryer cycle to allow automatic restarting of the cycle.

After the controller 28 re-enables the dryer 1 at 123 the controller 28 returns to 101 and repeats the steps from there.

Figure 7:
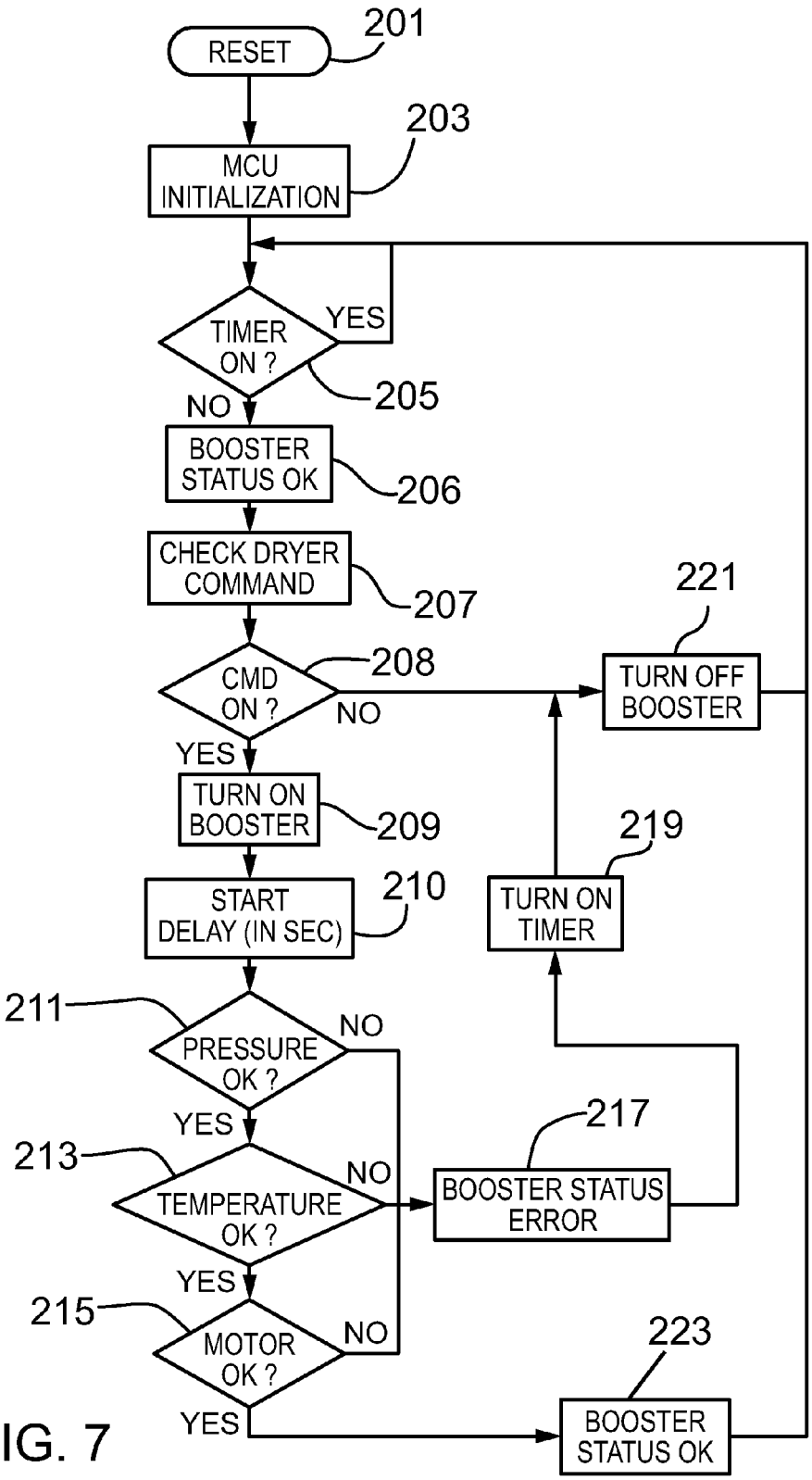
FIG. 7 is an example flowchart of the operation of an example booster fan controller in accordance with an aspect of the present invention for use in an interlock in accordance with an aspect of the present invention, such as the interlock of FIG. 1 or 5.

Referring to FIG. 7, in a manner similar to the controller 28, the controller 29 starts after a reset at 201 and follows with an initialization at 203 to setup the various components of the controller 28, such as registers. In addition to the reset options for the controller 28, the controller 29 may provide for reset upon a reset of the controller 28 as the controller 29 may not be accessible for a manual reset.

After initialization and as part of a continuous process, the controller 29 first checks at 205 to see if the controller 29 has just performed a status check and may be sending the results to the controller 28. This is done in the embodiment of the current FIG. by checking to see if its timer is on. If the timer is on then the controller 29 keeps checking at 205 until the timer expires. If the timer is off at 205 then the controller 28 indicates at 206 that the booster fan 5 status is OK. The controller 28 then at 207 checks for a command from the controller 28. If at 207 there is a command to turn on the booster fan 5 then at 209 the controller 29 turns on the booster fan 5, for example, by providing power to the booster fan 5 as described previously. The controller 29 then provides a start delay to wait for the booster fan 5 to turn on at 210. The start delay is a design choice, such as for example five minutes.

The controller 29 then at 211 checks if the pressure in OK in the vent duct 3 using the pressure sensor. If the pressure is OK then the controller 29 at 213 checks if the temperature is OK through the thermistor. If the pressure is OK then the controller 29 at 215 checks if the motor status is OK through one or more motor status sensors.

If any of the booster status checks fail then the booster fan 5 fails the status check and the controller at 217 communicates a booster status error to the controller 28. The controller 29 then at 219 turns on the controller 29 timer. The timer provides a delay to allow for a booster status error to be received by the controller 28.

The controller then at 221 turns off the booster fan 5, for example, by ceasing to provide power to the booster fan 5 as described previously. The controller 29 then returns to checking if the timer is on at 205.

If the controller 29 fails to receive a command from the controller 28 to turn on the booster fan 5 or receives a command to turn off then at 221 the controller 29 turns off the booster fan 5 and continues as discussed above. Although it is recognized not to be necessary, in the embodiment currently being described the booster fan 5 is turned off even if the booster fan 5 is already off.

If each of the status checks is OK then at 223 the controller communicates the booster status is OK to the controller 28. Then the controller 29 returns to checking to see if the timer is on at 205.

The flowcharts of FIGS. 6 and 7 are examples only. The interlock 25 may operate under alternative flows as will be evident to those skilled in the art. For example, the controller 28 can simply check the booster fan 5 status without initially checking for the presence of the booster fan 5. As another example, the controller 28 could simply disable the dryer 1 until the controller 28 is manually reset. As a further example, the steps of the flowchart for the controller 29 related to checking the booster fan 5 status through the sensors can be integrated into the check booster fan 5 status of the controller 28, and the controller 28 can check the status of the sensors and turn on and off the booster fan 5 directly.

Figure 8:
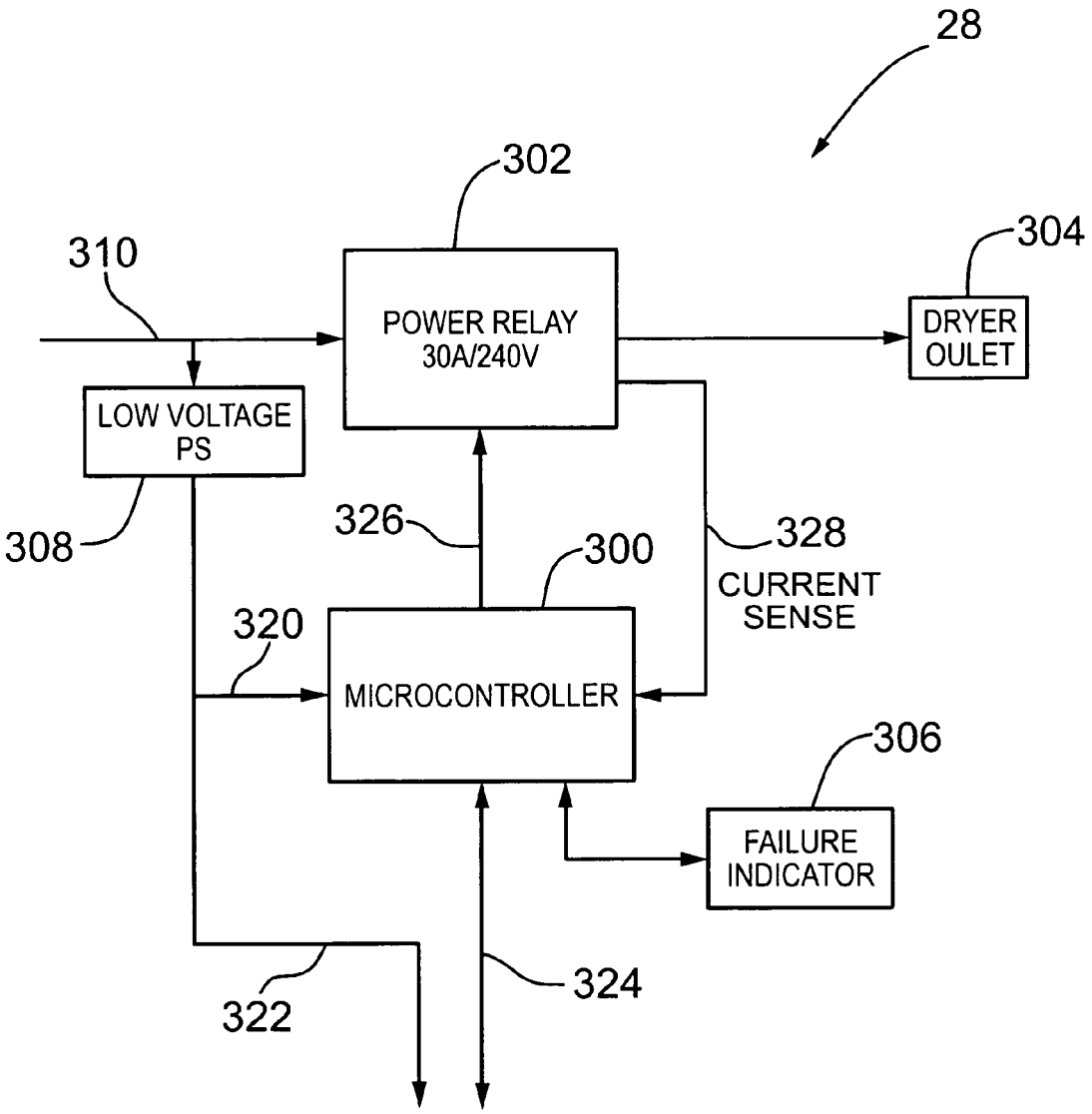
FIG. 8 is a block diagram of an example wired dryer controller in accordance with an aspect of the present invention for use in an interlock in accordance with an aspect of the present invention, such as the interlock of FIG. 1.

Referring to FIG. 8, a dryer controller 28 has a microcontroller 300, power relay 302, dryer outlet 304, failure indicator 306 and low voltage power supply 308. The controller 28 also has an input 310 for mains power, typically 240V three phase AC input for a dryer 1 for North America. 240V three phase mains power is an example only and inputs for other mains power can be utilized as desired.

The power supply 308 is connected to the mains power input 310 and converts the mains power to low voltage DC power to power the control components in the controller 28, such as the microcontroller 300 as indicated by the connection 320. Also, the power supply can be utilized to power the controller 29 as indicated by the connection 322.

The microcontroller 300 acts as a control unit for the dryer controller 28. A microcontroller for the control unit is an example only. One alternative example for the microcontroller could be a microprocessor with discrete memory. Further alternative might include discrete electrical components such as transistors, resistors and capacitors, and/or discrete logic gates to embody the functionality described herein.

Continuing with the microcontroller 300 example, the microcontroller 300 stores one or more programs to carry out the functions described herein. For example, the microcontroller 300 may store a program in accordance with the flowchart of FIG. 6.

The microcontroller 300 has inputs and outputs for communication with the controller 29 as shown by the connection 324. The microcontroller is connected to the failure indicator, for example an LED as described early to display an error from the booster fan 5 status.

The microcontroller 300 is also connected to the power relay at connection 326 to control the power relay 302. The power relay 302 is connected to the mains power input 310 and to the dryer outlet 304 to control the provision of power from the mains input 310 to the dryer outlet 304 to enable and disable the dryer outlet 304, such that a dryer 1 plugged into the dryer outlet 304 can be enabled and disabled as described herein. As described above, enabling and disabling the dryer in this manner utilizes power interruption. Other techniques can be used, some of which are described elsewhere herein.

The power relay 302 can have a current sense output 328 connected to the microcontroller 300. The current sense output 328 can be used by the microcontroller 300 to determine if current is flowing through the power relay 302 to indicate that the dryer 1 is running. For diagnostic purposes, the current sense 328 could be used by the microcontroller 300 to perform motor status checks on the dryer 1 in a similar manner to the motor status checks on the booster fan 5 as described above, taking into account the different operational parameters of the dryer 1 and the booster fan 5.

Alternatives can be used to the power relay with current sense, for example, a triac with current sense.

Figure 9:
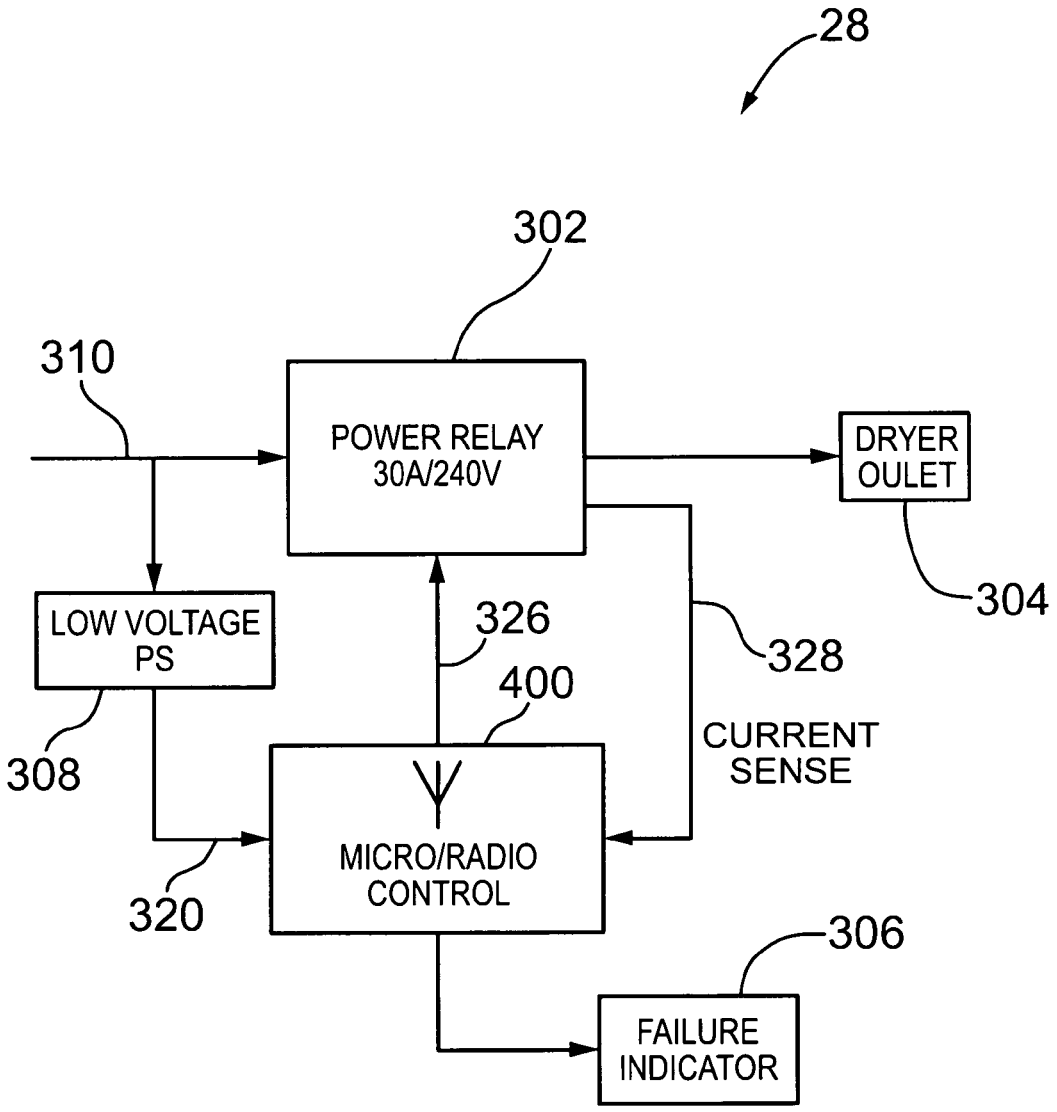
FIG. 9 is a block diagram of an example wireless dryer controller in accordance with an aspect of the present invention for use in an interlock in accordance with an aspect of the present invention, such as the interlock of FIG. 5.

Referring to FIG. 9, a controller 28 can replace the microcontroller 300 with a microcontroller with radio capabilities 400, and remove the power and communication wires to the controller 29. The microcontroller with radio capabilities 400 provides for wireless communications directly to the controller 29. This can be advantageous in particular in retrofit applications such that wires are not necessary between the controllers 28, 29. The wireless controller 28 of FIG. 9 otherwise operates in a similar manner to the wired controller 28 of FIG. 8.

Figure 10:
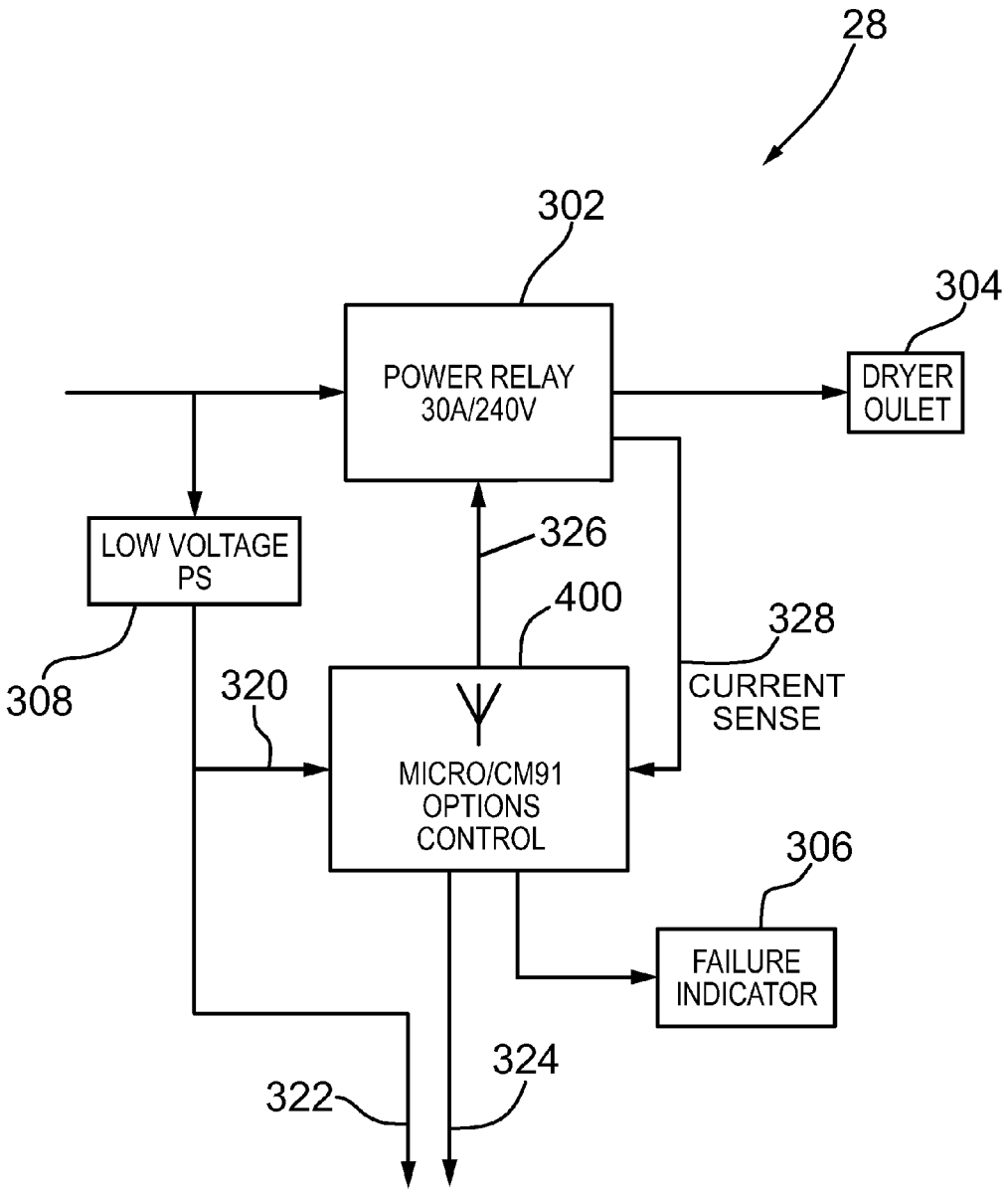
FIG. 10 is a block diagram of an example wired and wireless dryer controller in accordance with an aspect of the present invention for use in an interlock in accordance with an aspect of the present invention, such as the interlock of FIG. 1.

Referring to FIG. 10, a controller 28 can include both the microcontroller with radio capabilities 400 and the wired connections for power 322 and communications 324 to the controller 29.

Figure 11:
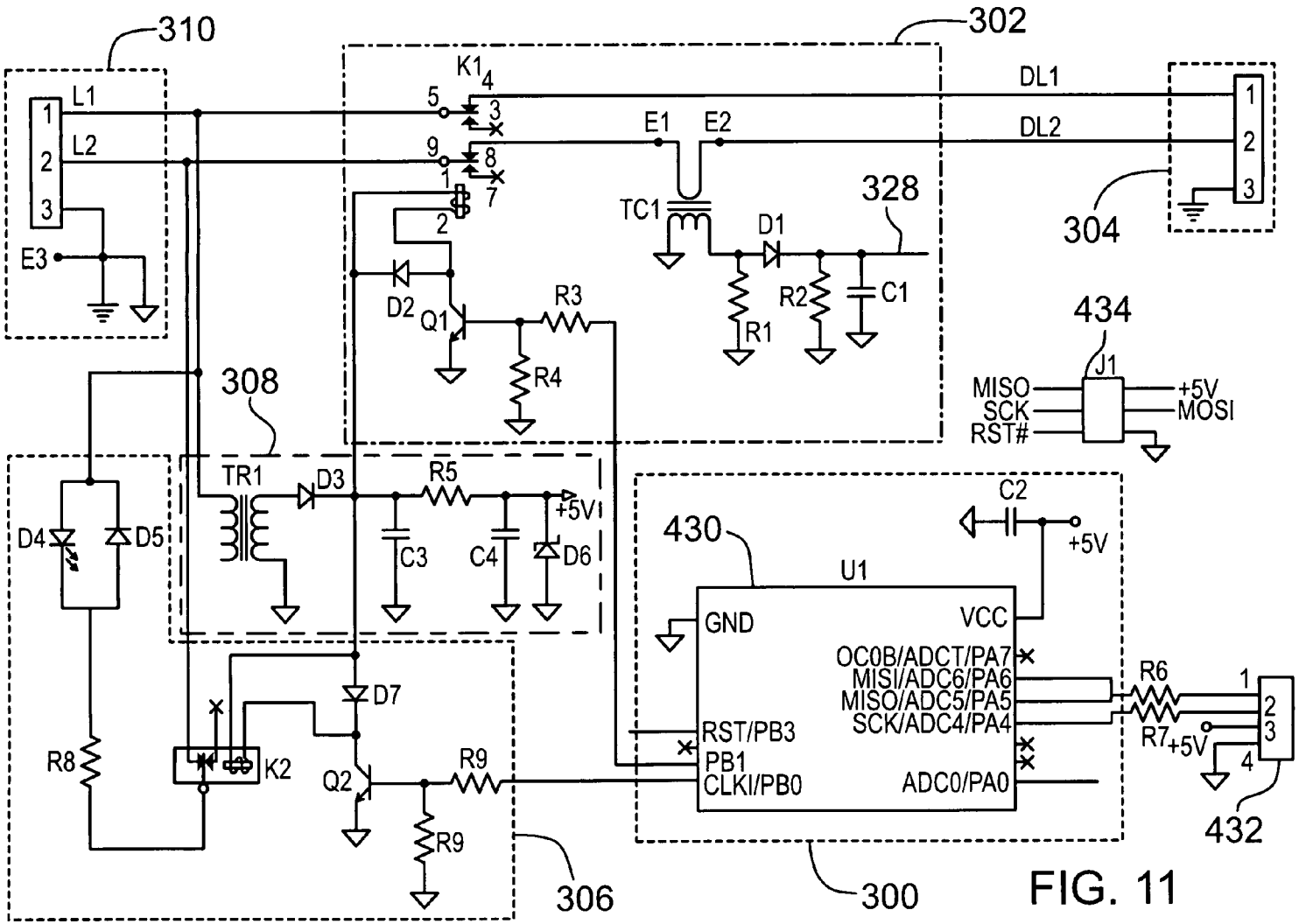
FIG. 11 is a detailed schematic diagram of an example wired dryer controller in accordance with an aspect of the present invention for use in an interlock in accordance with an aspect of the present invention, such as the interlock of FIG. 1.

Referring to FIG. 11, the microcontroller 300 of FIG. 8 can be implemented using an ATtiny 84 microcontroller 430. The blocks of FIG. 8 have been overlaid on the FIG. and the description of the function of the blocks will not be repeated. The microcontroller is connected to a connector 432 to provide the connection 322, 324 to the controller 29. A programming header 434 is provided to allow for programming of the microcontroller 430. In some instances the lines for connection between components have not been drawn in the FIG.; however, the connections have been labeled so as to be evident. Various example detailed connections between the components of the controller 28 are shown including labels for various inputs and outputs of the microcontroller 430, and example discrete component identifiers and sizes.

Figure 12:
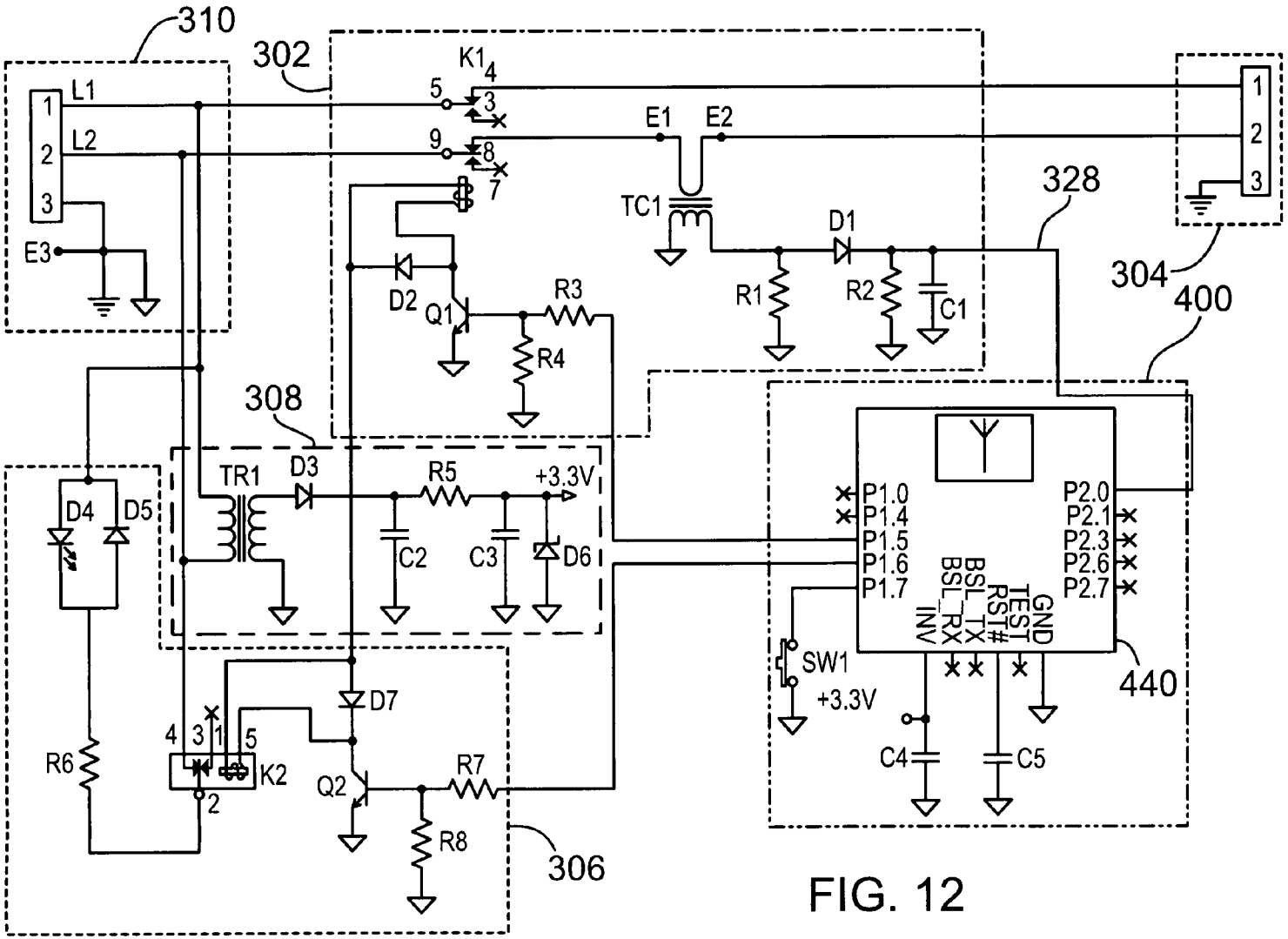
FIG. 12 is a detailed schematic diagram of an example wireless dryer controller in accordance with an aspect of the present invention for use in an interlock in accordance with an aspect of the present invention, such as the interlock of FIG. 5.

Referring to FIG. 12, the microcontroller 400 of FIG. 9 can be implemented using a CM91 MRF1 microcontroller 440 of Alutron Modules Inc of Aurora, Ontario, Canada.; however, it is to be recognized that the functions of microcontroller 440 could be provided in a separate microcontroller and transceiver, or receiver and transmitter. A suitable transceiver may be for example a Bluetooth wireless transceiver, many of which are available from a variety of suppliers, such as an OEM Bluetooth-Serial Module, Parani-ESD provided by SENA (www.sena.com). The blocks of FIG. 9 have been overlaid on the FIG. and the description of the function of the blocks will not be repeated. Where the controllers 28, 29 may used with various designs it is practical to program the microcontrollers in place after assembly. This is especially true if surface mount technology is used. If the microcontroller can be inserted during assembly then it might be possible to preprogram the microcontroller and insert it programmed; although, this is likely not as desirable a manufacturing process. In some instances the lines for connection between components have not been drawn in the FIG.; however, the connections have been labeled so as to be evident. Various example detailed connections between the components of the controller 28 are shown including labels for various inputs and outputs of the microcontroller 440, and example discrete component identifiers and sizes.

Figure 13:
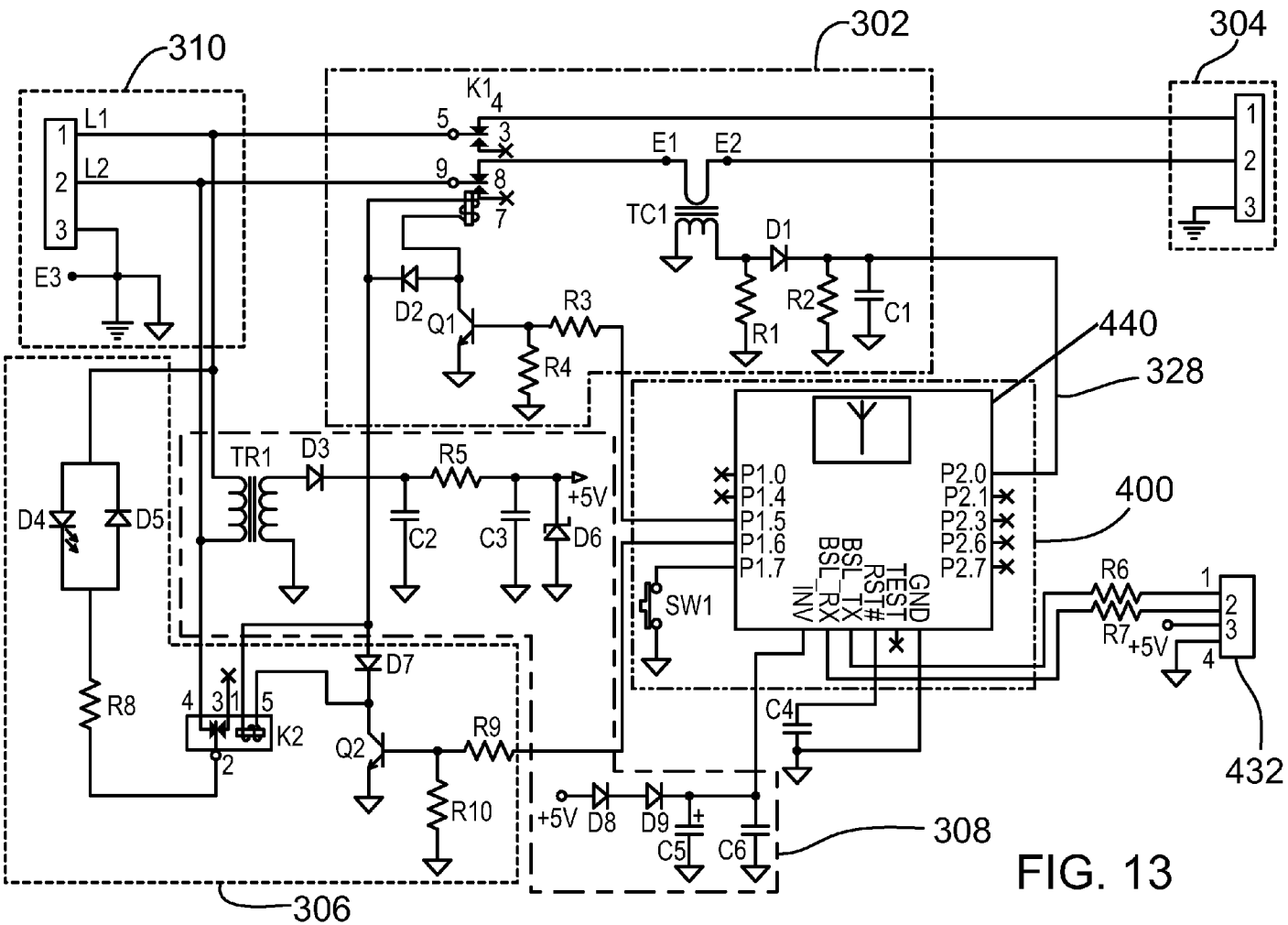
FIG. 13 is a detailed schematic diagram of an example wired and wireless dryer controller in accordance with an aspect of the present invention for use in an interlock in accordance with an aspect of the present invention, such as the interlock of FIG. 1.

Referring to FIG. 13, the microcontroller 440 of FIG. 12 can replace the microcontroller 430 of FIG. 11 to provide a wired and wireless communication solution for the controller 28.

Referring to FIG. 14, the microcontrollers 430 and 440 can be utilized together such that the microcontroller 430 provides wired functionality, while the microcontroller 440 provides wireless functionality. In the example shown in the FIG. the wired and wireless modes are exclusive of one another.

Figure 15:
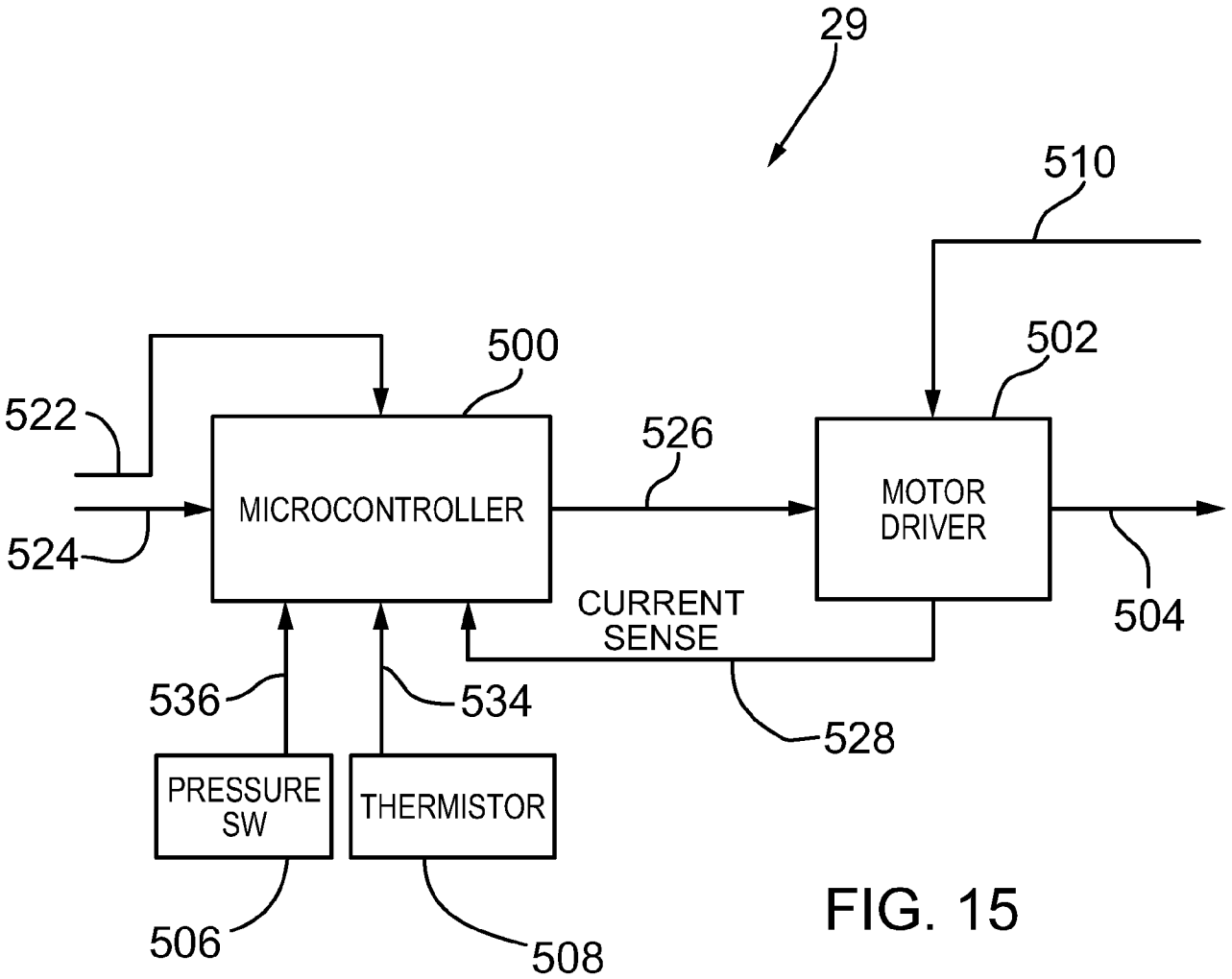
FIG. 15 is a block diagram of an example wired booster fan controller in accordance with an aspect of the present invention for use in an interlock in accordance with an aspect of the present invention, such as the interlock of FIG. 1.

Referring to FIG. 15, a booster fan controller 29 has a microcontroller 500, motor driver 502, booster fan outlet 504, pressure sensor 506 and thermistor 508. The controller 29 also has an input 510 for mains power, typically 120V single phase AC input for a booster fan 5 for North America. 120V single phase mains power is an example only and inputs for other mains power can be utilized as desired. As will be shown in later FIGS., the motor driver 502 can, for example, utilize a triac for motor control.

Power for the controller 29 is provided from the dryer controller 28 as indicated by the connection 522.

The microcontroller 500 acts as a control unit for the controller 29. A microcontroller for the control unit is an example only. One alternative example for the microcontroller could be a microprocessor with discrete memory. Further alternative might include discrete electrical components such as transistors, resistors and capacitors, and/or discrete logic gates to embody the functionality described herein.

Continuing with the microcontroller 500 example, the microcontroller 500 stores one or more programs to carry out the functions described herein. For example, the microcontroller 500 may store a program in accordance with the flowchart of FIG. 7.

The microcontroller 500 has inputs and outputs for communication with the controller 28 as shown by the connection 524.

The microcontroller 500 is also connected to the motor driver at connection 526 to control the motor driver 502. The motor driver 502 is connected to the mains power input 510 and to the booster fan 5 at connection 504 to control the provision of power from the mains input 510 to the booster fan through the connection 504 to turn on and off the booster fan 5 as described herein.

The motor driver 502 can have a current sense output 528 connected to the microcontroller 500. The current sense output 528 can be used by the microcontroller 500 to determine if current is flowing through the motor driver 502 to indicate that the booster fan 1 is on. For diagnostic purposes, the current sense 528 could be used by the microcontroller 500 to perform motor status checks on the booster fan 5 as previously described.

Alternatives can be used to the motor driver 502 with current sense, for example, a relay with current sense.

The thermistor 508 and pressure switch 506 are connected at 534 and 536 respectively to the microcontroller 500. The pressure switch 506 can be, for example, model series P1-SERIES PRESSURE SWITCH P/N P1.25.25.40.M9 W/112 MBAR as supplied by Lamb Industries of Portland Oreg. The thermistor 508 can be, for example, produced by Cantherm of Montreal Quebec Canada Referring to FIG. 16, a controller 29 can replace the microcontroller 500 with a microcontroller with radio capabilities 600, and remove the power and communication wires to the controller 28. The microcontroller with radio capabilities 600 provides for wireless communications directly to the controller 28. This can be advantageous in particular in retrofit applications such that wires are not necessary between the controllers 28, 29. The wireless controller 29 has a power supply 602 connected between the mains power input 510 and the microcontroller 600 to provide low voltage power to the microcontroller 600. The wireless controller 29 of FIG. 16 otherwise operates in a similar manner to the wired controller 28 of FIG. 8.

Figure 17:
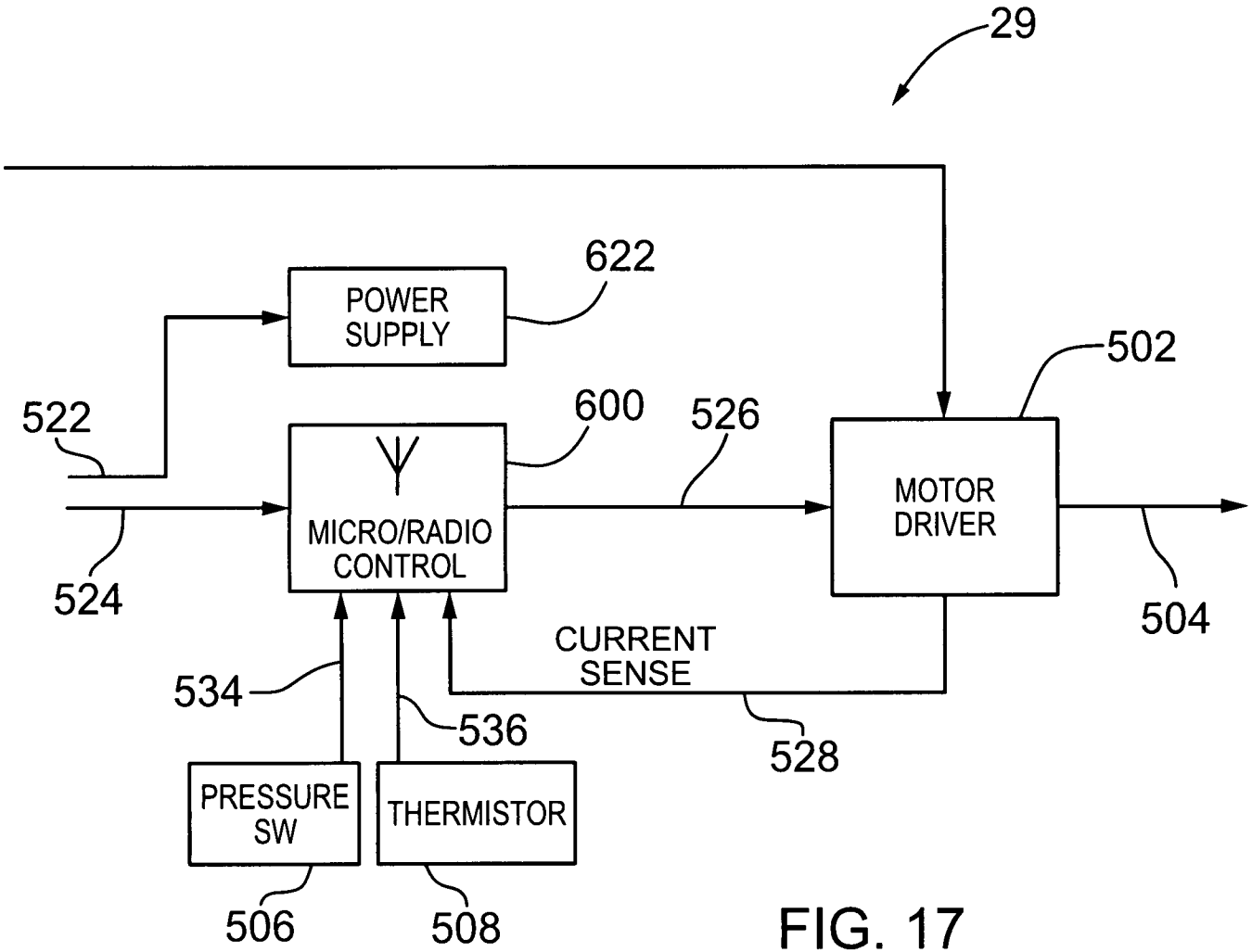
FIG. 17 is a block diagram of an example wired and wireless dryer controller in accordance with an aspect of the present invention for use in an interlock in accordance with an aspect of the present invention, such as the interlock of FIG. 1.

Referring to FIG. 17, a controller 29 can include both the microcontroller with radio capabilities 600 and the wired connections for power 622 and communications 524 to the controller 28.

Figure 18:
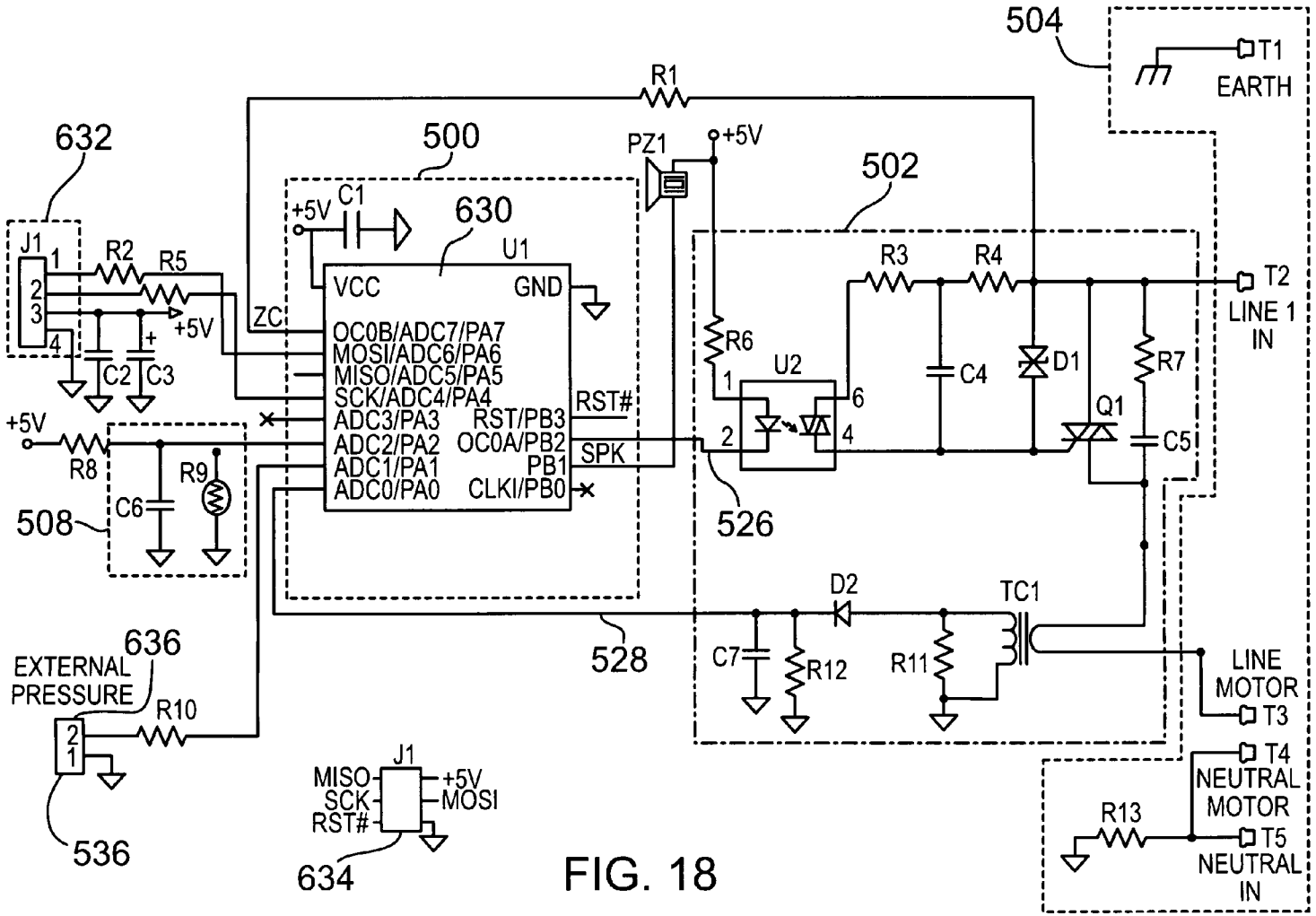
FIG. 18 is a detailed schematic diagram of an example wired booster fan controller in accordance with an aspect of the present invention for use in an interlock in accordance with an aspect of the present invention, such as the interlock of FIG. 1.

Referring to FIG. 18, the microcontroller 500 of FIG. 15 can be implemented using an ATtiny 84 microcontroller 630. ATtiny 84 micrcroncontrollers are provided by ATMEL Corporation of San Jose, Calif. The blocks of FIG. 15 have been overlaid on the FIG. and the description of the function of the blocks will not be repeated. The microcontroller 630 is connected to a connector 632 to provide the connection 522, 524 to the controller 28. A programming header 634 is provided to allow for programming of the microcontroller 630. In some instances the lines for connection between components have not been drawn in the FIG.; however, the connections have been labeled so as to be evident. A header 636 provides connection 536 to pressure switch 506, not shown in FIG. 18. Various example detailed connections between the components of the controller 29 are shown including labels for various inputs and outputs of the microcontroller 630, and example discrete component identifiers and sizes. ZC on the FIGS. is a zero crossing that allows for synchronization in motor control. The piezo devices shown on the FIGS. provide an audible alarm if desired, for example, for failure conditions.

Figure 16:
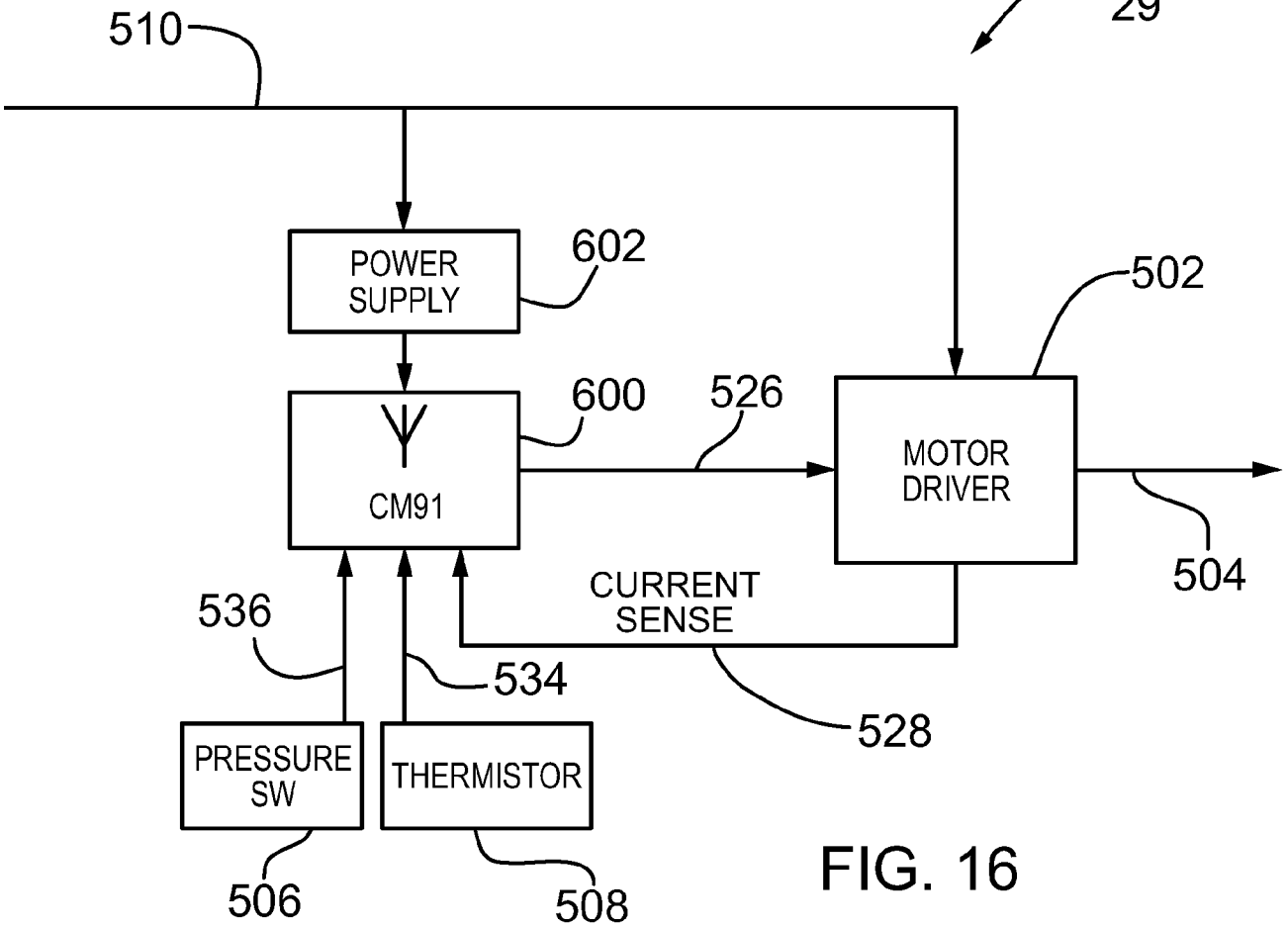
FIG. 16 is a block diagram of an example wireless booster fan controller in accordance with an aspect of the present invention for use in an interlock in accordance with an aspect of the present invention, such as the interlock of FIG. 5.
Figure 19:
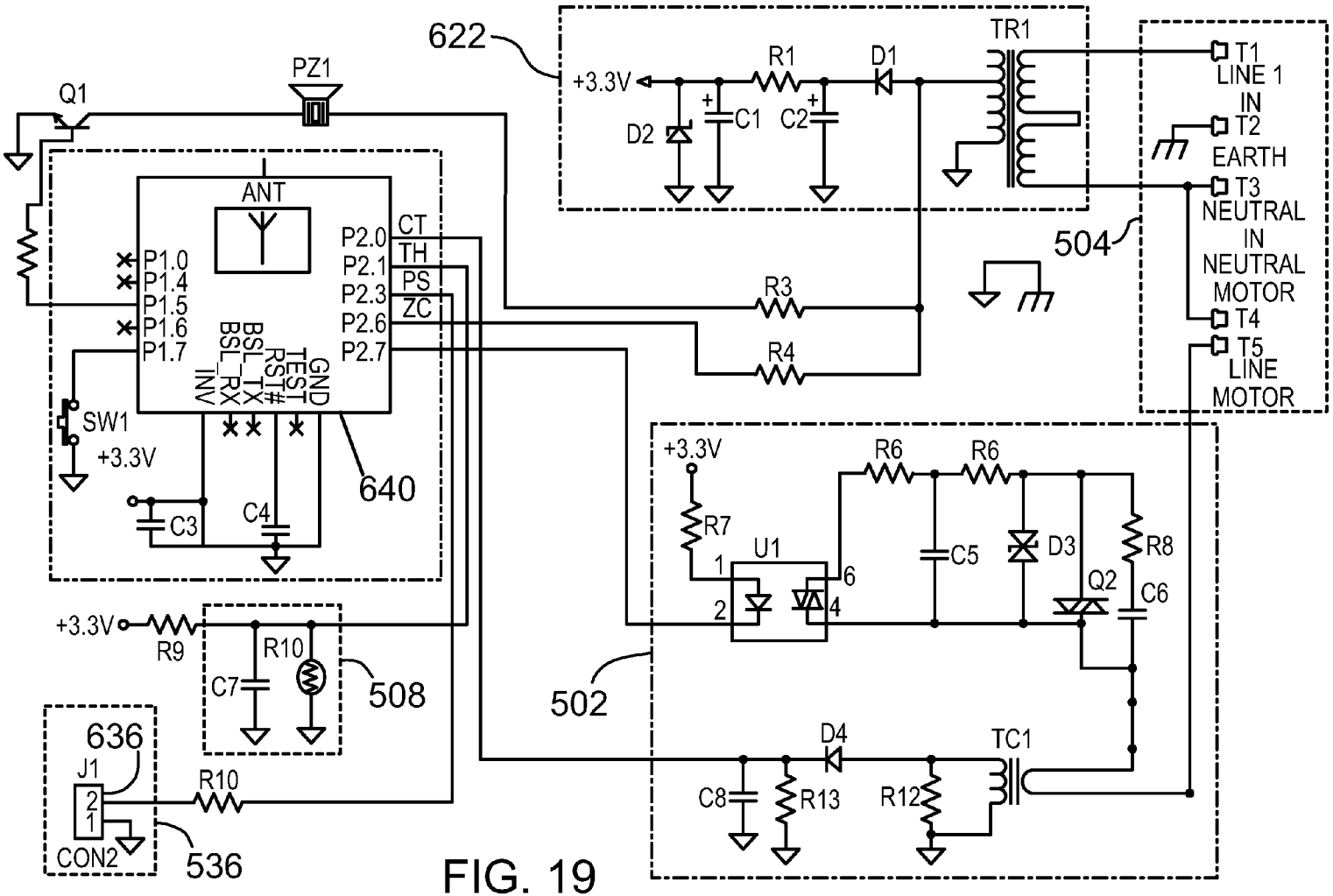
FIG. 19 is a detailed schematic diagram of an example wireless booster fan controller in accordance with an aspect of the present invention for use in an interlock in accordance with an aspect of the present invention, such as the interlock of FIG. 5.

Referring to FIG. 19, the microcontroller 600 of FIG. 16 can be implemented using a CM91 MRF1 microcontroller 640 of Alutron Modules Inc of Aurora, Ontario, Canada.; however, it is to be recognized that the functions of microcontroller 440 could be provided in a separate microcontroller and transceiver, or receiver and transmitter. A suitable transceiver may be for example a Bluetooth wireless transceiver, many of which are available from a variety of suppliers, such as an OEM Bluetooth-Serial Module, Parani-ESD provided by SENA (www.sena.com). The blocks of FIG. 16 have been overlaid on the FIG. and the description of the function of the blocks will not be repeated. The SW1 switch activates a learn mode that is utilized wirelessly. In some instances the lines for connection between components have not been drawn in the FIG.; however, the connections have been labeled so as to be evident. Various example detailed connections between the components of the controller 29 are shown including labels for various inputs and outputs of the microcontroller 640, and example discrete component identifiers and sizes.

Figure 20:
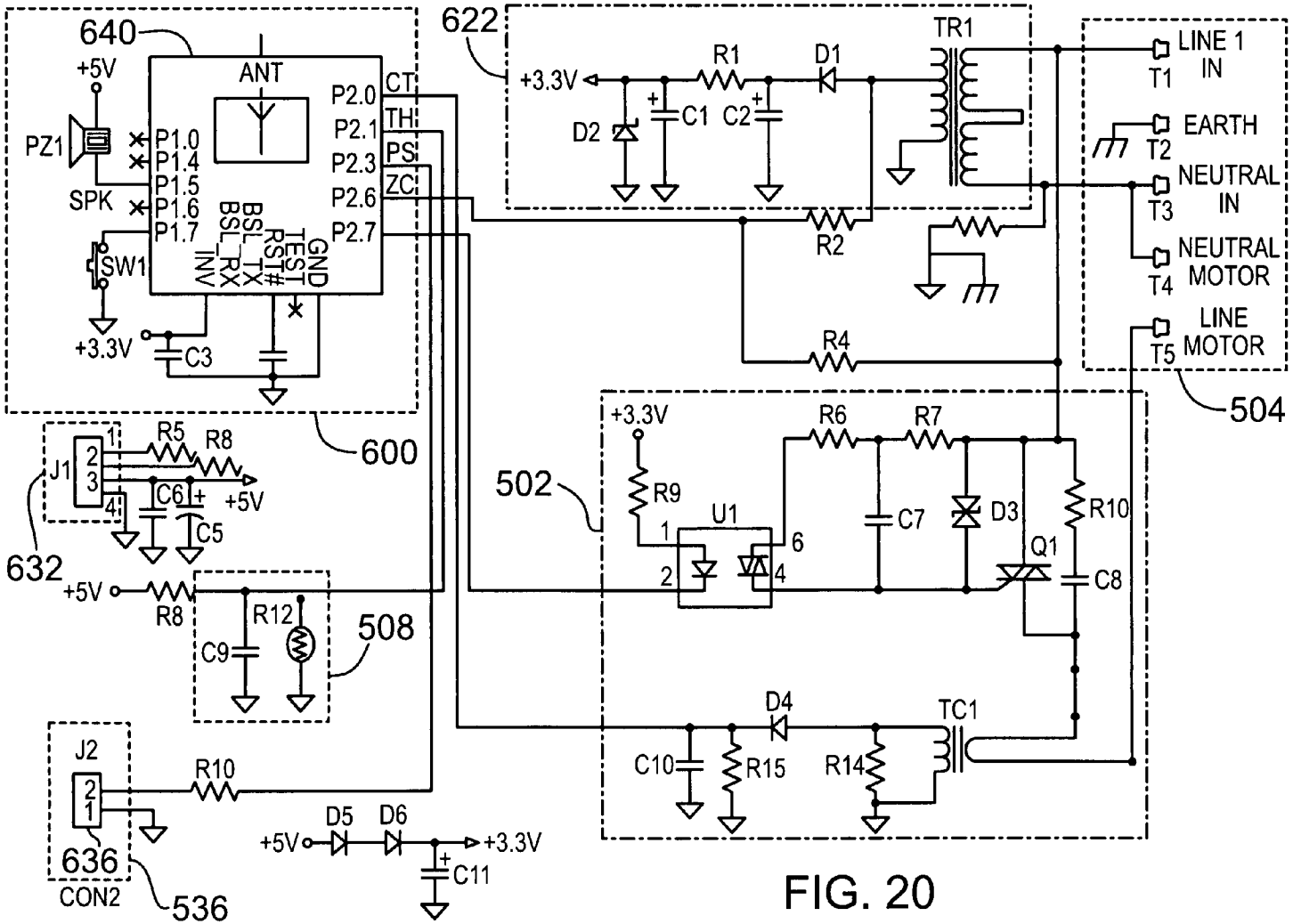
FIG. 20 is a detailed schematic diagram of an example wired and wireless booster fan controller in accordance with an aspect of the present invention for use in an interlock in accordance with an aspect of the present invention, such as the interlock of FIG. 1.

Referring to FIG. 20, the microcontroller 640 of FIG. 19 can replace the microcontroller 630 of FIG. 18 to provide a wired and wireless communication solution for the controller 29.

Figure 21:
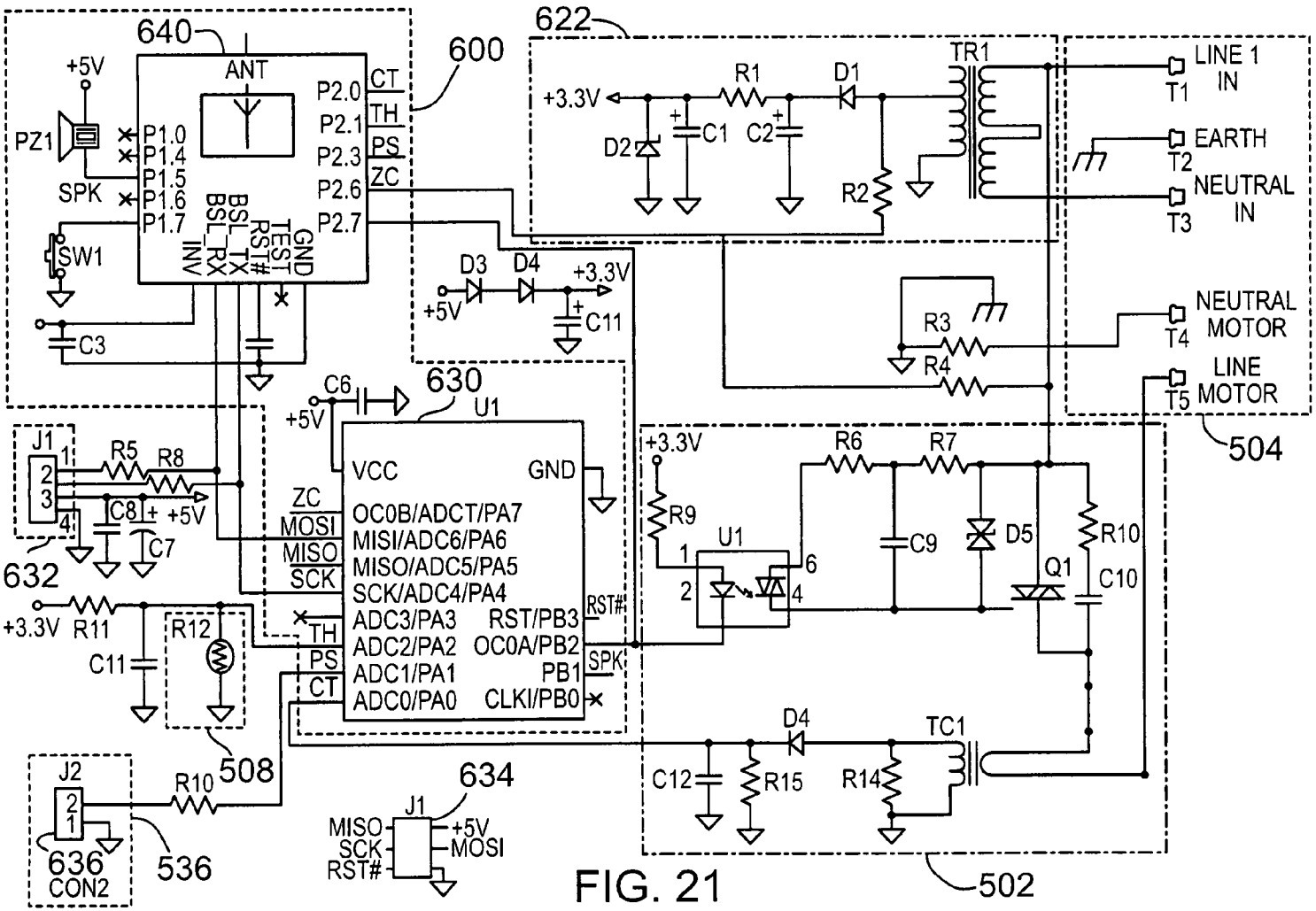
FIG. 21 is a detailed schematic diagram of a further example wired and wireless booster fan controller in accordance with an aspect of the present invention for use in an interlock in accordance with an aspect of the present invention, such as the interlock of FIG. 1.

Referring to FIG. 21, the microcontrollers 630 and 640 can be utilized together such that the microcontroller 630 provides wired functionality, while the microcontroller 640 provides wireless functionality. In the example shown in the FIG. the wired and wireless modes are exclusive of one another.

It is possible to provide more complex control of the booster fan 5 beyond simply turning it on and off. For example, the controller 29 can be programmed to adjust the speed at which a motor in the booster fan 5 operates to attempt to bring the dryer venting system 23 into proper operation, such as within acceptable pressure, temperature or velocity ranges. A velocity sensor, not shown but similar to the temperature sensor or pressure sensor in placement and operation with respect to the controllers 28, 29, can be placed in the venting system to sense velocity for the interlock 25. In addition to standard fluid flow velocity sensors, pressure sensors or thermistors could be adapted to the purpose of velocity sensing depending on the desired sensitivity. Velocity ranges, both minimum and maximum can be subject to regulation. An example suitable range can be between 1200 feet per minute (6.1 meters per second) and 2200 feet per minute (10.2 meters per second) at the vent 4. Motor speed adjustment can also be used to optimize the operating condition of the booster fan 5, for example to conserve energy while maintaining the proper operation of the dryer venting system 23.

Many different techniques for adjusting motor speed can be used, some of which are dependent on the type of motor. For example, the speed of a universal motor can be controlled by reducing the voltage applied to the motor. The speed of a DC motor (not typically used for booster fans) can be adjusted by adjusting the voltage for a series wound motor, or by controlling the excitation on the armature of a shunt wound motor.

Where the controller 29 has the ability to control motor speed then it may be desirable to provide for a "soft start". This can be done by starting the motor at a slower desired speed and working up to a higher speed. This can increase the longevity of the motor, particularly for universal motors where starting can result in a high inrush current that has a cumulative detrimental effect on motor windings over time. Soft start control can be configured as an internal setting of the controller 29 without requiring external user input.

Many power stages can be used to decrease (and to increase) the voltage to the motor. For example, as shown in the FIGS., the booster fan controller may utilize a triac (Q1, FIGS. 18, 20, 21; Q2, FIG. 19). A triac can be easily controlled using other solid-state components such as, for example, the microcontroller shown in the FIGS. The triac can be driven by a gate signal from the microcontroller that is phase shifted depending on the effective voltage desired. This is known as a phase-angle drive. At a minimum it requires only a gate driving signal and a single additional component: the triac.

More complex power stages, not shown, may be used to control the voltage from voltage source inputs seen by the motor using, for example, an input rectifier, a power switch (transistor) and a diode. Pulse Width Modulation may be used for a gate drive signal to adjust the effective voltage seen by the motor to be varied. This is known as a chopper drive.

Figure 22:
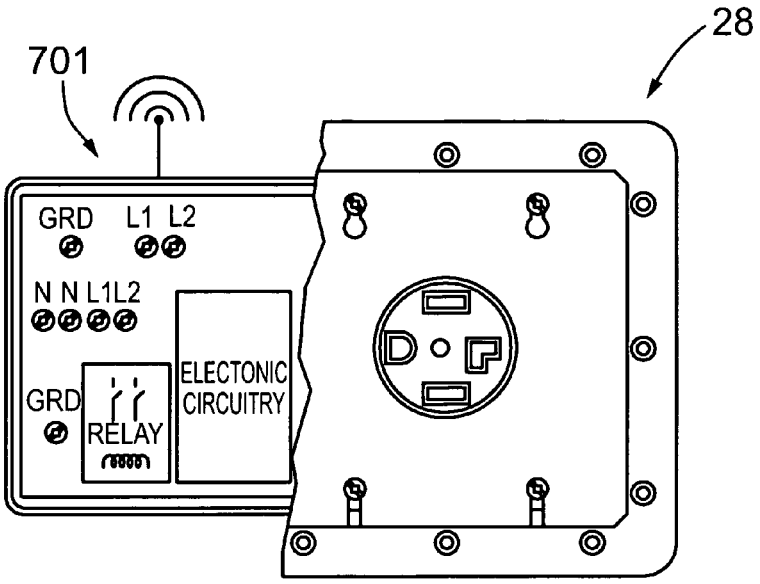
FIG. 22-24 are front and top views of example of wireless dryer controllers corresponding to the wired dryer controllers of FIGS. 2, 3B and 3C respectively in accordance with an aspect of the present invention for use, for example, in the interlock of FIG. 5.
Figure 23:
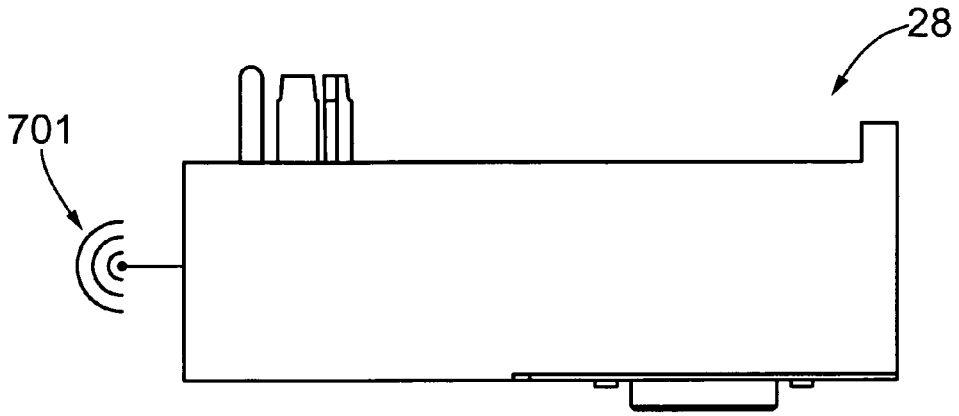
Figure 24:
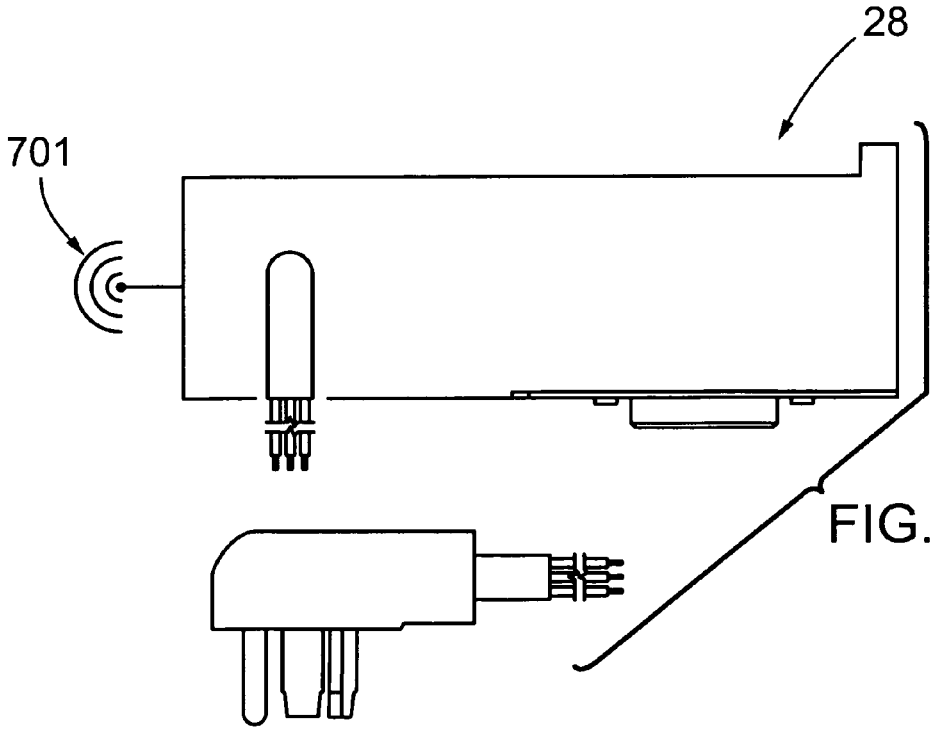

Referring to FIGS. 22-24, wireless embodiments of the dryer controller 28 for use in an interlock 25 of FIG. 5 generally correspond to the controller 28 as described in FIGS. 2, 3B and 3C; however, the wires 30 have been replaced by antenna 701. Accordingly, the description will not be repeated, nor will detailed reference numerals be used.

Figure 25:
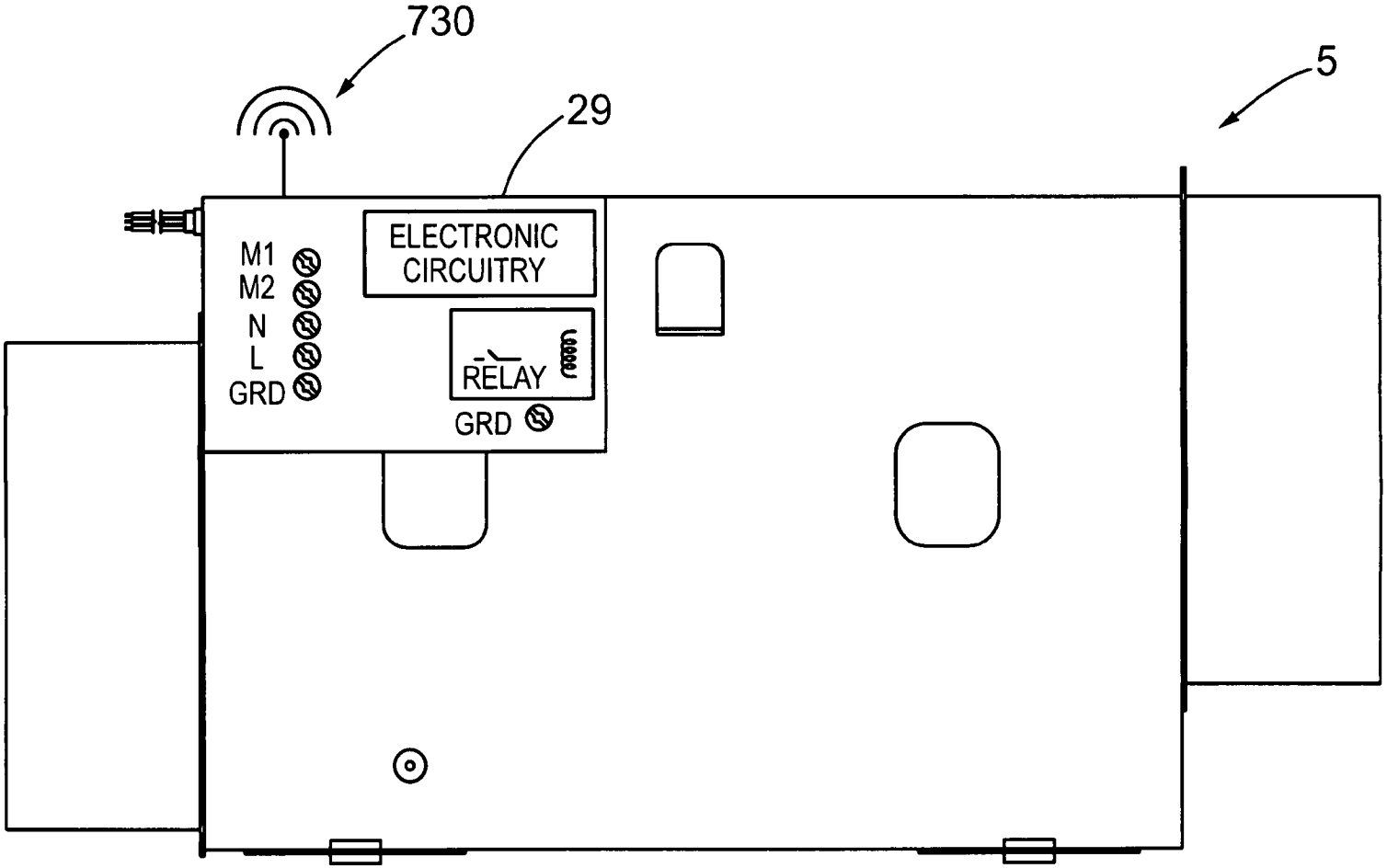
FIG. 25 is a front view of example wireless booster controller corresponding to the wired booster fan controller of FIG. 4 in accordance with an aspect of the present invention for use, for example, in the interlock of FIG. 5.

Referring to FIG. 25, a wireless embodiment of the booster fan controller 29 for use in an interlock 25 of FIG. 5 generally corresponds to the controller 29 as described in FIG. 4; however, the wires 30 have been replaced by antenna 730. Accordingly, the description will not be repeated, nor will detailed reference numerals be used.

Figure 26:
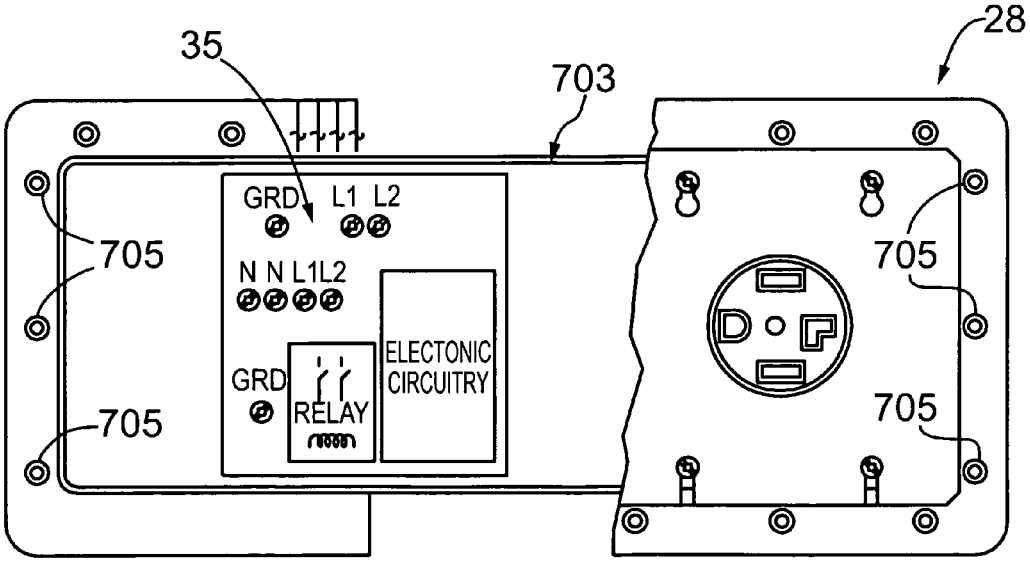
FIG. 26 is a front view of an alternate housing for the dryer controller of FIG. 2 in accordance with an embodiment of an aspect of the present invention for use, for example, in the interlock of FIG. 1.

Referring to FIG. 26, an extended version of the dryer controller 28 generally corresponds with the controller 28 illustrated in FIG. 2; however, the housing 31 has been replaced with a housing 703 that is laterally extended. This allows for possible placement across two wall studs, not shown. Typically wall studs are at sixteen inch centers in North America. As an example, the extended housing 703 could be provided with mounting holes, such as holes 705, at opposing ends of the housing 703 sixteen inches apart. The housing 703 can then be flat across the rear with an opening for receiving conductors 13 directly into the connectors 35, while replacing the receptacle 11. The housing 31 could be similarly modified to receive the conductors 13 without an extended housing 703; however, the extended housing 703 provides additional mounting security that may be required in some jurisdictions for a hardwired control 28. The extended housing 703 controller 28 is otherwise similar to the housing 31 controller 28 of FIG. 2; accordingly, the remaining description will not be repeated, nor will detailed reference numerals be used. The extended version of the dryer controller 28 could also be mounted vertically for example, to a single stud using, for example, screws through flanges similar to flanges 47 of FIG. 4 either through a side of the housing for flush mount or through the rear of the housing for surface mounting. A vertically mounted dryer controller 28 could be positioned such that the receptacle is hidden by the dryer while the portion of the housing to contain the circuitry extends above the dryer such that the failure indicator 306 is visible, i.e. not hidden by the dryer. Similarly, a horizontally mounted controller 28 could be mounted such that the receptacle is hidden by the dryer, while the portion containing the circuitry extends beyond the dryer such that the failure indicator 306 is visible, i.e. not hidden by the dryer.

The interlock 25 can provide continuous monitoring of the operation of the venting system 23. Such monitoring can include continuous monitoring of the operation of the booster fan 5. Such operation is currently typically tested only manually when the booster fan 5 is installed or being serviced.

Figure 27:
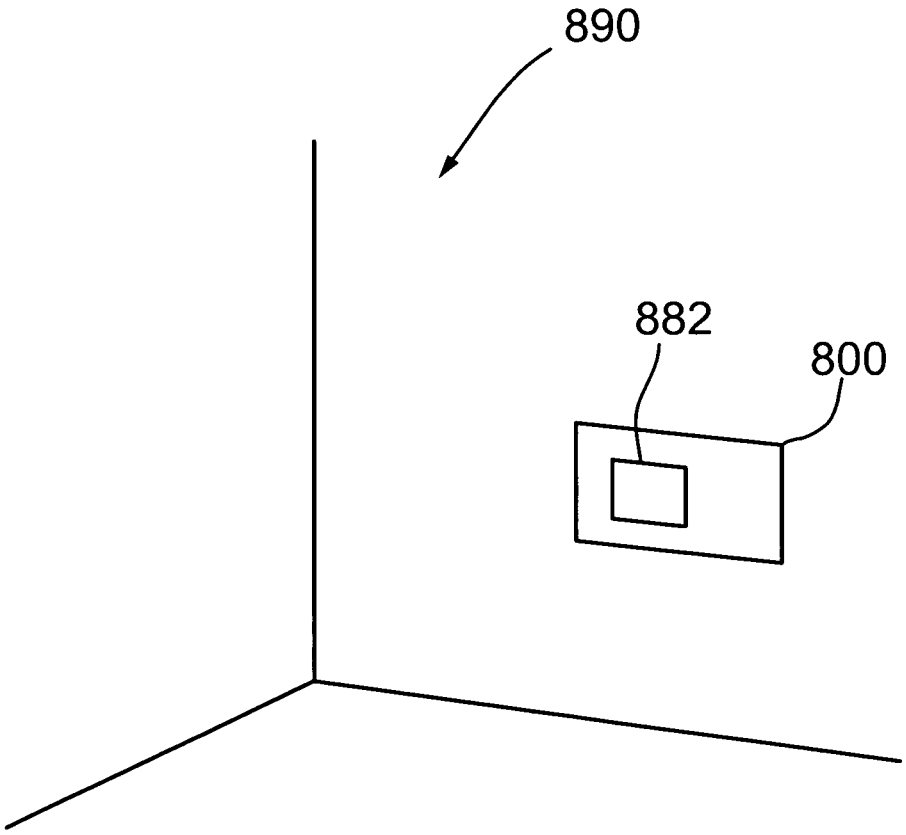
FIG. 27 is a front view of an example embodiment of a remote station that may be used with the interlock of FIG. 1 or 5.

Referring to FIG. 27, a remote station 800 having a display 882, such as an LCD screen with or without touch screen functions, could be place within a building 890 to receive information from the interlock 25. The remote station 800 could be mounted to a wall or elsewhere within the building 890, or it could be portable. The remote station 800 could communicate wirelessly with the interlock 25 in the same manner as the dryer controller 28 and the booster fan controller 29 communicate with one another. The remote station 800 may allow for two-way communication and, in this way, the remote station 800 can duplicate, replace or augment some or all of the functions of the interlock 25. The interlock 25 could provide additional information regarding the cause for an alarm, or the status of the venting system 23 for display on the screen of the remote station 800. Alternatively, the remote station 800 could simply provide a remote alarm via an LED or other visible or audible signalling device to indicate a problem in the dryer venting system 23.

The remote station 800 could also access other automated functions in the building 890. In this way, the need for multiple remote control screens in a building 890 could be reduced. Communication between the remote station 800 and the central control module 3 can be through an intermediary transceiver, such as an x10 control module adapted to wirelessly receive signals from and transmit signals to the central control module 3 and to correspondingly transmit signals to the remote station 800 and receive signals from the remote station 800.

The transmission to and reception from the remote station 800 by the intermediary transceiver may be wireless or wired. For example, power line communication could be used, or network cabling. The remote station 800 could be a personal or other computer, or a dedicated device, such as an x10 compatible control panel.

It will be understood by those skilled in the art that this description is made with reference to the preferred embodiments thereof and that it is possible to make other embodiments employing the principles of the invention which fall within its spirit and scope as defined by the following claims.

I claim:

1. A dryer interlock for use with a dryer and a dryer venting system, the interlock comprises:

a sensor configured to be placed in the dryer venting system to sense operation of the dryer venting system, a controller operationally connected to the sensor and configured to monitor a sensed operation of the dryer venting system as sensed by the sensor, the controller configured to determine if the sensed operation is indicative of improper operation of the dryer venting system, the controller configured to disable the dryer if the controller determines that the sensed operation is indicative of improper operation of the dryer venting system, wherein the dryer venting system includes a booster fan, and the controller of the dryer interlock further comprises a dryer controller and a booster fan controller, wherein the sensor is operationally connected to the booster fan controller and the booster fan controller is configured to monitor the sensed operation from the sensor, and the dryer controller is configured to disable the dryer if the booster fan controller determines that the sensed operation is indicative of improper operation of the dryer venting system, and the booster fan controller and dryer controller are configured to allow the booster fan controller to communicate with the dryer controller; and wherein the booster fan controller is further configured to turn on the booster fan, and the dryer controller is further configured to sense running of the dryer, and the dryer controller is configured to communicate with the booster fan controller when the dryer controller senses that the dryer is running, and the booster fan controller is adapted to turn on the booster fan when the dryer controller senses that the dryer is running and communicates with the booster fan controller.

2. The interlock of claim 1 wherein the booster fan controller and dryer controller are configured to communicate wirelessly.

3. The interlock of claim 1 wherein the dryer controller is configured to be operationally connected between mains power and the dryer such that the dryer controller can disable the dryer by interrupting power to the dryer.

4. The interlock of claim 1 wherein the dryer controller comprises a relay to operationally connect between mains power and the dryer such that the dryer controller can disable the dryer by interrupting power through the relay.

5. The interlock of claim 1 wherein the sensor comprises a current sensor configured to be operationally connected to the booster fan to sense the current drawn by the booster fan.

* * * * *